US006873309B2

(12) United States Patent
Suzuki et al.

(10) Patent No.: US 6,873,309 B2
(45) Date of Patent: Mar. 29, 2005

(54) DISPLAY APPARATUS USING LUMINANCE MODULATION ELEMENTS

(75) Inventors: Mutsumi Suzuki, Kodaira (JP); Toshiaki Kusunoki, Tokorozawa (JP); Masakazu Sagawa, Inagi (JP)

(73) Assignee: Hitachi, Ltd., Tokyo (JP)

( * ) Notice: Subject to any disclaimer, the term of this patent is extended or adjusted under 35 U.S.C. 154(b) by 322 days.

(21) Appl. No.: 09/788,374

(22) Filed: Feb. 21, 2001

(65) Prior Publication Data

US 2002/0093469 A1 Jul. 18, 2002

(30) Foreign Application Priority Data

Nov. 28, 2000 (JP) ..... 2000-365768

(51) Int. Cl.[7] ..... G09G 3/30

(52) U.S. Cl. ..... 345/76; 345/75.2; 345/78; 345/82

(58) Field of Search ..... 345/74, 76, 82, 345/156, 92–100; 445/50

(56) References Cited

U.S. PATENT DOCUMENTS

| | | | | |
|---|---|---|---|---|
| 3,696,393 A | * | 10/1972 | McDonald | 345/74 |
| 4,471,227 A | * | 9/1984 | D'Ascenzo | 345/74 |
| 4,961,630 A | * | 10/1990 | Baron et al. | 345/74 |
| 5,593,335 A | * | 1/1997 | Suzuki et al. | 445/50 |
| 5,719,589 A | * | 2/1998 | Norman et al. | 345/82 |
| 5,929,845 A | * | 7/1999 | Wei et al. | 345/156 |
| 6,169,528 B1 | * | 1/2001 | Oguchi et al. | 345/74 |
| 6,201,520 B1 | * | 3/2001 | Iketsu et al. | 345/76 |

FOREIGN PATENT DOCUMENTS

JP 57-22289 2/1982

OTHER PUBLICATIONS

Hosokawa, C.; Eida, M.I; Matsure, M.; Fukuoka, K.; Nakamura, H.; Kusumoto, T. and Idemitsu Kosan Co., Ltd., L2.3: Organic Multicolor EL Display with Fine Pixels (SID 97 Digest), pp. 1073–1076, published May 1997.

Shimoda, T.; Kimura, M.; Miyashita, S., Seiko–Epson Corp; Friend, R.H.; Burroughes J.; Towns C; Cambridge Display Technologies, Ltd., 26.2: Invited Paper: Current Status and Future of Light–Emitting Polymer Display Driven by Poly–Si TFT (SID 99 Digest), pp. 372–375, published May 1999.

Meyer, R., 6" Diagonal Microtips Fluorescent Display for T.V. Applications EURODISPLAY 90, 10$^{th}$ International Display Research Conference Proceedings (Vdeverlag, Berlin, 1990) pp. 374–377.

(Continued)

*Primary Examiner*—Bipin Shalwala
*Assistant Examiner*—David L. Lewis
(74) *Attorney, Agent, or Firm*—Reed Smith LLP; Stanley P. Fisher, Esq.; Juan Carlos A. Marquez, Esq.

(57) ABSTRACT

A display apparatus includes: a plurality of luminance modulation elements each modulated in luminance by a voltage of a positive polarity applied thereto, each of the luminance modulation elements being not modulated in luminance by a voltage of an opposite polarity applied thereto; a plurality of first lines electrically coupled to first electrodes of the plurality of luminance modulation elements; a plurality of second lines electrically coupled to second electrodes of the plurality of luminance modulation elements, the plurality of second lines intersecting the plurality of first lines; a first drive unit coupled to the plurality of first lines, the first drive unit outputting scanning pulses; and a second driver unit coupled to the plurality of second lines. The first drive unit sets the first lines in a nonselection state to a high impedance state having a higher impedance as compared with the first lines in a selection state.

25 Claims, 23 Drawing Sheets

OTHER PUBLICATIONS

Koshida, N.; Ozaki, T; Sheng, X. and Koyama, H., Cold Electron Emission from Electroluminescent Porous Silicon Diodes Japanese Journal of Applied Physics, vol. 34, Part 2, No. 6A, pp. L705–L707, 1995.

Negishi, N.; Chuman, T.; Iwasaki, S.; Yoshikawa, T.; Ito, H, and Ogasaware, K., High Efficiency Electron–Emission in Pt/$SiO_x$/Si/Al Structure Japanese Journal of Applied Physics, vol. 36, part 2, No. 7B, pp. L939–L941, 1997.

Xueping Xu and George R. Brandes, Carbon Nanotube-Based Vacuum Microelectronic Gated Cathode Materials Research Society Symposium Proceedings, vol. 509, 1998, pp. 107–112.

Hong, D.; Aslam, D.M.; Poly–Diamond Gated Field–Emitter Display Cells IEEE Transaction Electron Devices, vol. 46, No. 4, 1999, pp. 787–791.

* cited by examiner

DISPLAY APPARATUS USING LUMINANCE MODULATION ELEMENTS

The present invention is related to PCT Application No. JP00/05989 filed on Sep. 4, 2000.

BACKGROUND OF THE INVENTION

The present invention relates to an image display apparatus and an image display apparatus drive method, and in particular to a technique which is effective when applied to an image display apparatus having a plurality of luminance modulation elements arranged in a matrix pattern.

As image display apparatuses having a plurality of luminance modulation elements arranged in a matrix pattern, there are, for example, liquid crystal displays, field emission displays (FEDs), and organic electroluminescence displays. A luminance modulation element is an element whose luminance is changed according to the applied voltage. In the case of liquid crystal displays, the luminance corresponds to the transmittance or reflectance. In the case of displays using luminous elements such as field emission displays and organic electroluminescence displays, the luminance corresponds to brightness of luminescence.

Such displays have an advantage that the thickness of the image display apparatus can be made thin.

Therefore, such displays are effective especially as portable image display apparatuses.

SUMMARY OF THE INVENTION

In portable image display apparatuses, low power consumption is an important characteristic. Furthermore, in display apparatuses of stationary type and display apparatuses of desktop type as well, low power consumption is desirable from the viewpoint of effective use of energy and from the viewpoint of reduction of heat generation of the display apparatus.

In a conventional technique, however, large power required to charge and discharge an electric capacitance the luminance modulation element has become a factor of large power consumption.

In order to make problems of the conventional technique clear, power consumption caused in an image display apparatus using a luminance modulation element matrix when a conventional drive method is used will now be estimated roughly. It is now assumed that a light emission element is used as the luminance modulation element.

FIG. 12 is a diagram showing a schematic configuration of a luminance modulation element matrix.

At each of intersections of row electrodes 310 and column electrodes 311, a luminance modulation element 301 is formed.

In FIG. 12, the case of three rows by three columns is illustrated. As a matter of fact, however, as many luminance modulation elements 301 as the number of pixels forming the display apparatus are arranged. Or in the case of a color display apparatus, as many luminance modulation elements 301 as the number of sub-pixels are arranged.

In a typical example, the number of rows N is in a range of several hundreds to several thousands, and the number of columns M is in a range of several hundreds to several thousands.

In the case of color image display, a combination of red, blue and green sub-pixels form one pixel. Herein, a sub-pixel in the case of color image display is also referred to as "pixel." Or a pixel in the case of single color display and a sub-pixel in the case of color display are generally referred to as "dot" in some cases.

FIG. 13 is a timing chart showing a drive method of a conventional image display apparatus.

One (selected row electrode) of the row electrodes 310, such as, for example, the electrode 310-1 is supplied with a pulse (scanning pulse) of a negative polarity having an amplitude ($V_K$) from corresponding one 41-1 of row electrode drive circuits 41. At the same time, from some of column electrode drive circuits 42, such as, for example, 42-2 and 42-3, a positive polarity pulse (data pulse) having an amplitude $V_{data}$ is applied to corresponding column electrodes 311-2 and 311-3 (selected column electrodes).

Luminance modulation elements 301 supplied with both the scanning pulse and the data pulse, here, 301-12 and 301-13 are supplied with a voltage large enough to become luminous. As a result, the elements 301-12 and 301-13 become luminous.

Luminance modulation elements which are not supplied with the positive polarity pulse of the amplitude $V_{data}$ are not supplied with a sufficient voltage, and consequently the luminance modulation elements do not become luminous.

A selected row electrode 310, i.e., a row electrode 310 supplied with the scanning pulse is selected one after another, and a data pulse applied to the column electrodes 311 in association with the row is also changed.

By thus scanning all rows in one field interval, an image corresponding to an arbitrary image can be displayed.

Assuming now that a capacitance of each of the luminance modulation elements 301 is Ce, the number of column electrodes 311 is M, and the number of row electrodes is N (where M and N are integers), dissipation power (also called reactive power) (or reactive power) consumption of the drive circuits using the conventional drive method will now be derived.

The dissipation power consumption is power consumed to charge and discharge electric charge across the capacitance of a driven element, and it does not contribute to light emission.

First, dissipation power consumption caused by applying scanning pulses will be derived.

Dissipation power in the case where a pulse having the amplitude $V_K$ is applied to the row electrodes 310 once is represented by the following expression (1):

$$M \cdot Ce \cdot (V_K)^2 \quad (1).$$

Assuming that the number of times of rewriting the screen per second (field frequency) is f, dissipation power $P_{row}$ of N row electrodes is represented by the following expression (2).

$$P_{row} = f \cdot N \cdot M \cdot Ce \cdot (V_K)^2 \quad (2)$$

N luminance modulation elements 301 are connected to one column electrode 311. In the case where a pulse voltage is applied to all of M column electrodes 311, therefore, dissipation power ($P_{col}$) of M column electrodes is represented by the following expression (3).

$$P_{col} = f \cdot M \cdot N \cdot (N \cdot Ce \cdot (V_{data})^2) \quad (3)$$

In an interval for updating the screen once (one field interval), pulses are applied to the column electrodes N times. As compared with $P_{row}$, therefore, N is multiplied additionally.

In the case where the pulse voltage is applied to m of M column electrodes 311, M should be replaced by m in the expression (3).

As an example, the case where organic electroluminescence elements are used as the luminance modulation elements will now be considered. Assuming that the diagonal length is 6 inches, luminous efficiency is 5 lm/W, f=60 Hz, N=240, M=960, Ce=12 pF, $V_K$=−7 V, and $V_{data}$=8V as typical values, we get $P_{row}$=0.01 [W] and $P_{col}$=2 [W].

When the average luminance is set to 50 cd/m$^2$, then the power consumption of the organic electroluminescence elements is approximately 0.3 [W]. Therefore, overall power consumption is approximately 2.3 [W]. Thus, it is clear that the dissipation power $P_{col}$ caused by applying the data pulses occupies most of the power consumption.

As described earlier, the dissipation power is power which does not contribute to the luminescence of the luminance modulation elements. Therefore, it is desirable to reduce the dissipation power. As indicated by the above described example, it is obvious that reducing the dissipation power $P_{col}$ caused by applying the data pulses is effective for that purpose.

The present invention has been made in order to solve the above described problem of the conventional technique. An object of the present invention is to provide an image display apparatus and its drive method capable of reducing the dissipation power in the luminance modulation element matrix in the image display apparatus.

In accordance with an aspect of the present invention, there is provided in order to achieve the above described object an image display apparatus including: a plurality of luminance modulation elements each modulated in luminance by a voltage of a positive polarity applied thereto, each of the luminance modulation elements being not modulated in luminance by a voltage of an opposite polarity applied thereto; a plurality of first lines electrically connected to first electrodes of the plurality of luminance modulation elements; a plurality of second lines electrically connected to second electrodes of the plurality of luminance modulation elements, the plurality of second lines intersecting the plurality of first lines; a first drive unit connected to the plurality of first lines, the first drive unit outputting scanning pulses; and a second drive unit connected to the plurality of second lines; the first lines in a nonselection state are set to a high impedance state having a higher impedance as compared with the first lines in a selection state, or the first and second lines in a nonselection state are set to a high impedance state having a higher impedance as compared with the first and second lines in a selection state.

On the basis of a result of the present invention, the present inventors have conducted a preceding technique survey from the viewpoint of providing unselected electrodes with a high impedance.

As a result, the pertinent technique has not been found as to the image display apparatus using unipolar luminance modulation elements which is the subject of the present invention.

DETAILED DESCRIPTION OF THE EMBODIMENTS

Prior to description of embodiments of the present invention, the principle and features of the present invention will be described.

Figure 1:
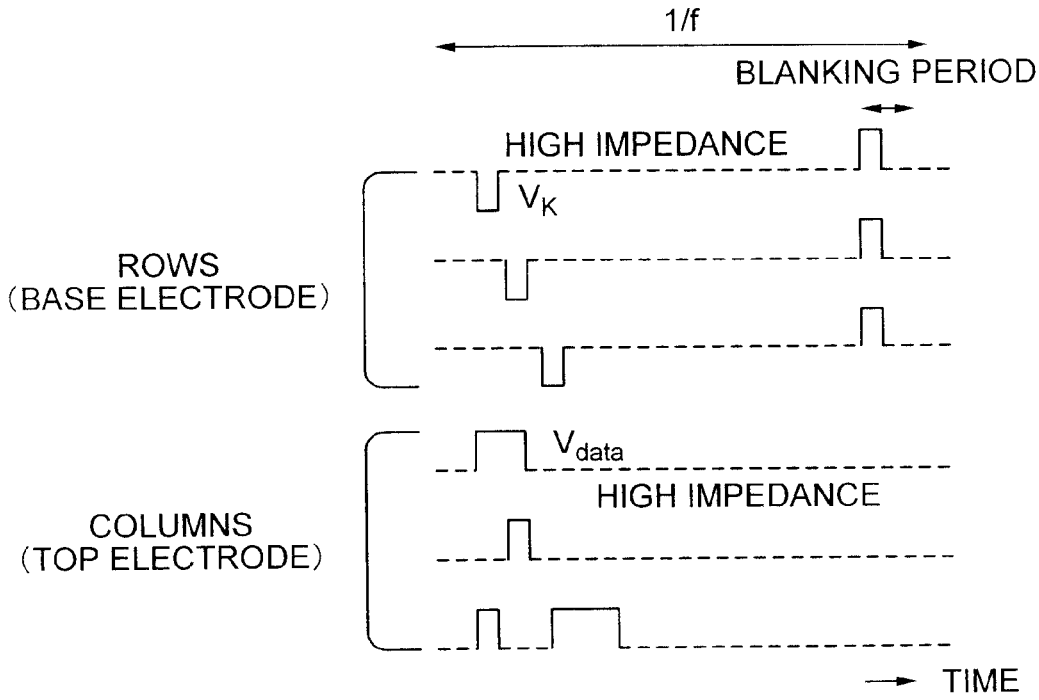
FIG. 1 is a diagram showing a drive method of an image display apparatus according to the present invention.

In accordance with the present invention, for example, unselected row electrodes 310, or unselected row electrodes 310 and column electrodes 311 are set to a high impedance state as shown in a timing chart of FIG. 1.

For setting row electrodes 310 or column electrodes 311 to a high impedance state, there are methods such as a method of setting output signal lines of row electrodes 310 or column electrodes 311 to a floating state within, for example, row electrode drive circuits 41 or column electrode drive circuits 42.

Power consumption in a luminance modulation element matrix according to a drive method of an image display apparatus of the present invention will now be roughly estimated.

First, the case where outputs of row electrode drive circuits 41 for supplying drive voltages to unselected row electrodes 310 are set to the high impedance state will now be considered.

Figure 2:
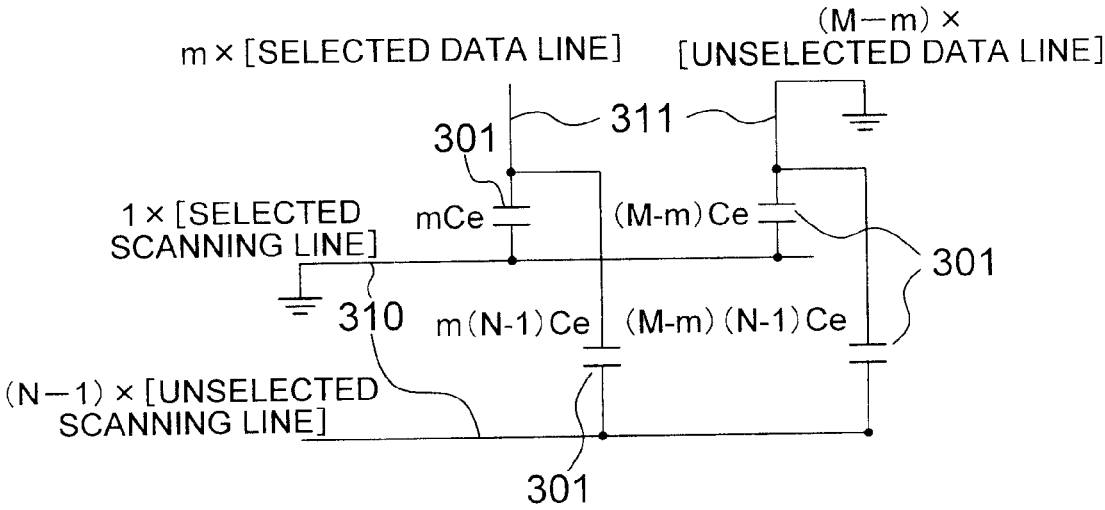
FIG. 2 is a diagram showing an equivalent circuit for calculating a capacitance between electrodes in a drive method of an image display apparatus according to the present invention.

FIG. 2 is a diagram showing an equivalent circuit in the case where one row electrode (selected scanning line of FIG. 2) 310 is selected whereas N−1 remaining row electrodes (unselected scanning lines of FIG. 2) 310 are set to the high impedance state, and at the same time m column electrodes (selected data lines of FIG. 2) 311 are selected whereas (M−m) unselected column electrodes (unselected data lines of FIG. 2) 311 are fixed to the ground (earth) potential, where M, N and m are integers.

Besides m luminance modulation elements 301 located at intersections of the selected row electrode 310 and the selected column electrodes 311 as shown in FIG. 2, a circuit network passing through the unselected row electrodes 310 and the unselected column electrodes 311 must also be taken into consideration.

In the equivalent circuit shown in FIG. 2, a capacitance $C_1(m)$ between one selected row electrode 310 and m selected column electrodes 311 is represented by the following expression (4):

$$C_1(m) = \left\{m + \frac{m(M-m)(N-1)}{M}\right\}C_e \tag{4}$$

Figure 3:
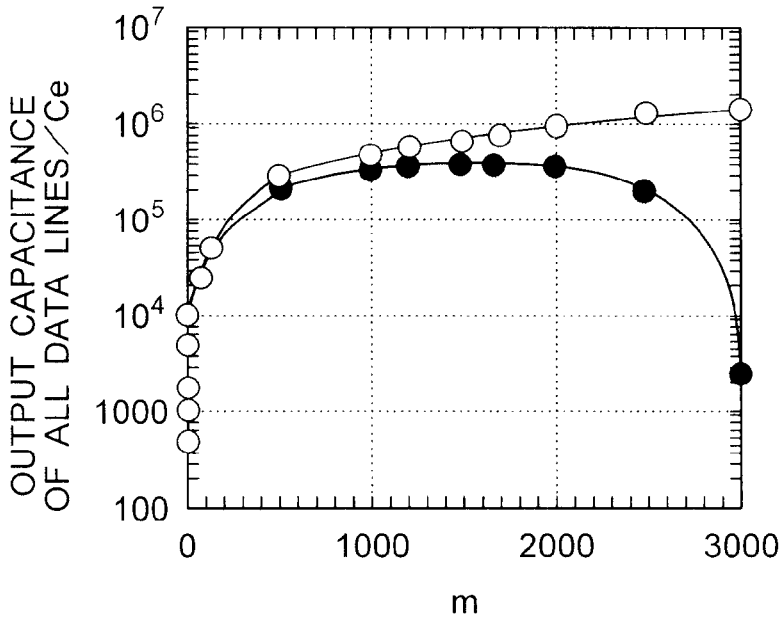
FIG. 3 is a graph showing a change of the capacitance between electrodes derived by using an equivalent circuit of FIG. 2.

FIG. 3 is a graph showing how $C_1(m)$ changes with m.

In FIG. 3, the axis of coordinates indicates an output capacitance of all column electrodes 311 divided by a capacitance Ce per pixel.

In FIG. 3, N=500 and M=3000, and ○ indicates the case of the conventional drive method whereas ● indicates the case of the drive method according to the present invention.

$C_1(m)$ becomes maximum when m=M/2. Even at that time, $C_1(m)$ is one fourth of the maximum value of the case of the conventional drive method.

Owing to the drive method of the present invention, therefore, dissipation power ($P_{col}$) caused by data pulse application can be reduced to one fourth.

The case where the unselected column electrodes 311 are also set to the high impedance state will now be described.

Figure 4:
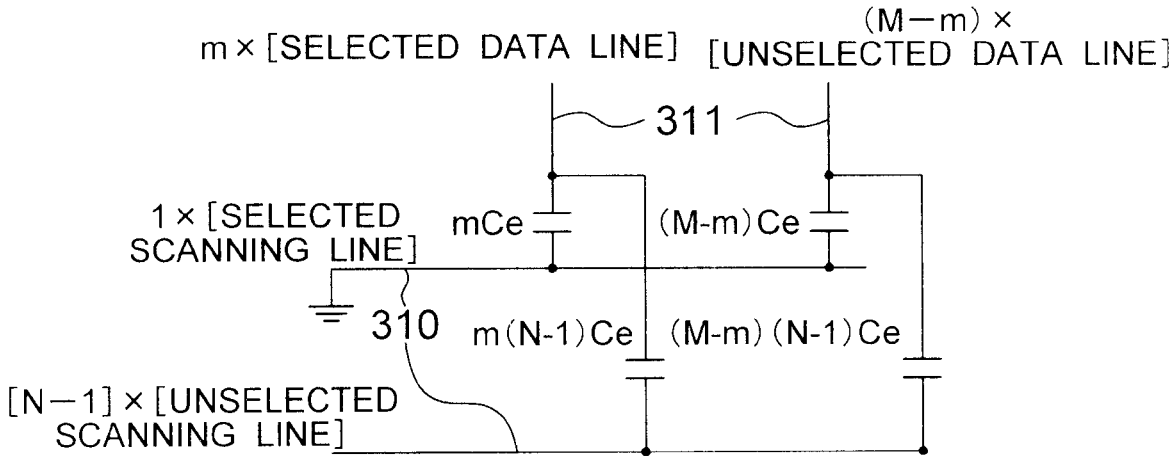
FIG. 4 is a diagram showing an equivalent circuit for calculating a capacitance between electrodes in a drive method of an image display apparatus according to the present invention.

FIG. 4 is a diagram showing an equivalent circuit in the case where one row electrode (selected scanning line of FIG. 4) 310 is selected whereas N−1 remaining row electrodes (unselected scanning lines of FIG. 4) 310 are set to the high impedance state, and at the same time m column electrodes (selected data lines of FIG. 4) 311 are selected whereas (M−m) unselected column electrodes (unselected data lines of FIG. 4) 311 are set to the high impedance state.

In the equivalent circuit shown in FIG. 4, a capacitance $C_2(m)$ between one selected row electrode 310 and m selected column electrodes 311 is represented by the following expression (5):

$$C_2(m) = \left\{m + \frac{m(M-m)(N-1)}{M+m(N-1)}\right\}C_e \tag{5}$$

Figure 5:
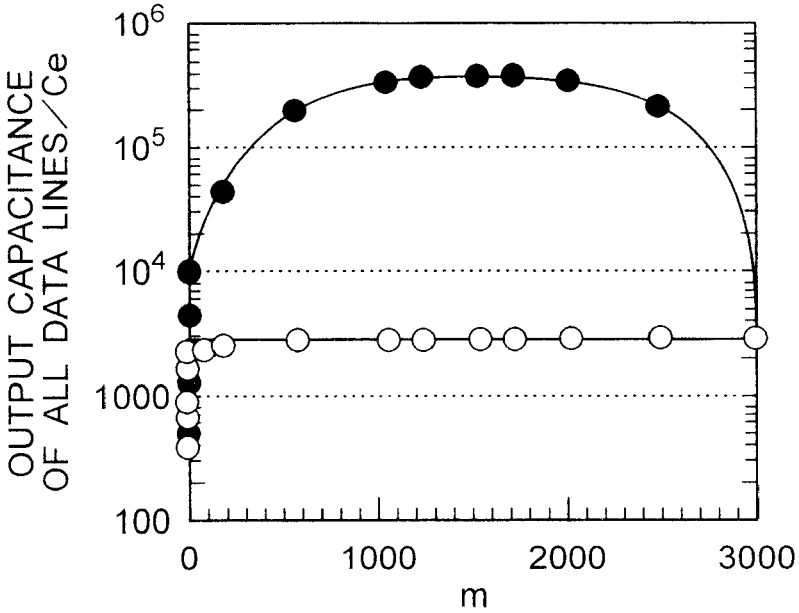
FIG. 5 is a graph showing a change of a capacitance between electrodes derived by using an equivalent circuit of FIG. 4.

FIG. 5 is a graph showing how $C_2(m)$ changes with m.

In FIG. 5, the axis of coordinates indicates an output capacitance of all column electrodes 311 divided by the capacitance Ce per pixel.

In FIG. 5, N=500 and M=3000, and ○ indicates $C_2(m)$ whereas ● indicates the case where only the unselected scanning electrodes are set to the high impedance state ($C_1(m)$).

For example, when m=M/2, $C_2(m)$ can be further reduced to one hundredth or less as compared with $C_1(m)$.

Owing to the drive method of the present invention, therefore, dissipation power ($P_{col}$) caused by data pulse application can be reduced to one hundredth or less as compared with the conventional technique.

In general, in the drive method of matrix type displays such as liquid crystal display apparatuses, it is avoided to set an electrode or electrodes to the high impedance state.

The reason is as follows: if there is an electrode of the high impedance state, then a crosstalk phenomenon becomes apt to occur, and consequently an image quality deterioration occurs. Or in some cases this results in malfunction that a desired image cannot be displayed.

The present inventors have paid attention to the fact that crosstalk occurrence due to the introduction of the high impedance state is caused because an electrode of the high impedance state has an unfixed voltage value, that is, the voltage is changed by the number of lit dots (i.e., a display image) located around the electrode and voltage changes of adjacent electrodes.

And the present inventors have studied in detail a voltage value induced on the electrode of the high impedance state. As a result, the present inventors have found a condition under which crosstalk does not occur.

First, the case of the drive method of setting only unselected row electrodes to the high impedance state will now be considered. In this case, an induced voltage $V_{FGscan}$ induced on an unselected row electrode is represented by the following expression (6):

$$V_{FGscan} = \frac{m}{M} V_{data} = \gamma V_{data} \tag{6}$$

where $\gamma = m/M$ is a ratio of the number of luminance modulation elements being in the ON state in one row, and it is herein referred to as ON ratio (lighting ratio). $V_{data}$ is an amplitude voltage of the data pulse.

Figure 14:
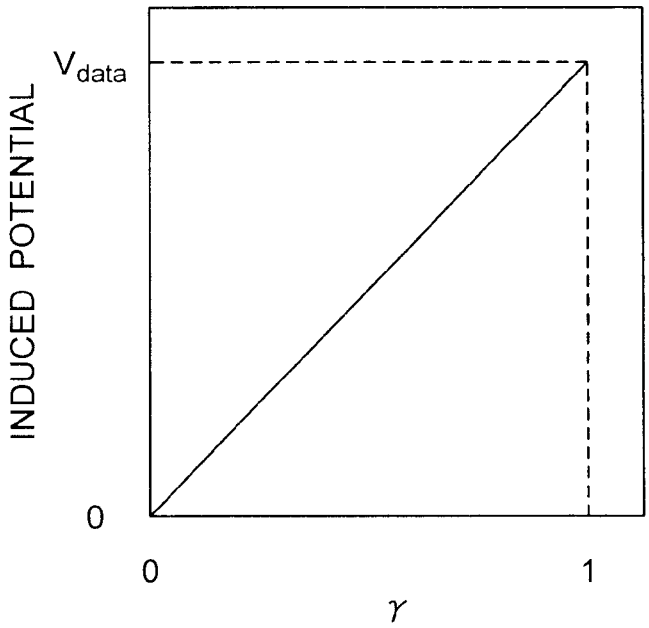
FIG. 14 is a diagram showing an induced potential generated when each of unselected rows is provided with a high impedance.

A result thereof is shown in FIG. 14. As appreciated from the result, a potential induced on an unselected row electrode is a positive potential irrespective of the ON ratio. Connection is conducted so that a luminance modulation element will become luminous when a positive voltage is applied to a column electrode thereof and a negative voltage is applied to a row electrode thereof. Therefore, this induced voltage is an opposite polarity for the luminance modulation element. In the case where there is used such an element as not to become luminous even if a voltage of opposite polarity is applied, therefore, crosstalk does not occur.

An element which does not become luminous even if a voltage of opposite polarity is applied, or more generally speaking, an element which does not assume the selection state in luminance modulation state is hereafter referred to as "unipolar luminance modulation element" in a sense that luminance is modulateld only by applying a voltage of positive polarity. On the other hand, an element which becomes luminous or assumes the selection state in luminance modulation state even if a voltage of opposite polarity is applied is hereafter referred to as "bipolar luminance modulation element" in a sense that luminance is modulated by applying a voltage of either of two polarities: positive and negative polarities. As for examples of the bipolar luminance modulation elements, there are liquid crystal elements and thin film inorganic electroluminescence elements. As for examples of unipolar luminance modulation elements, there are organic electroluminescence elements and electron emission elements combined with a phosphor material.

As evident from the foregoing description, it can be said that "luminance is not modulated under the opposite polarity" so long as crosstalk of display does not occur when a voltage of opposite polarity is applied. Even if an element conducts luminance modulation very slightly when a voltage of opposite polarity is applied thereto, it can be regarded that "luminance modulation is not conducted" substantially holds true, so long as the luminance modulation state is not visible to human eyes or the luminance modulation state is within such a range as not to pose a problem as a display apparatus. Therefore, such an element can be regarded as a "unipolar" luminance modulation element.

Figure 38A:
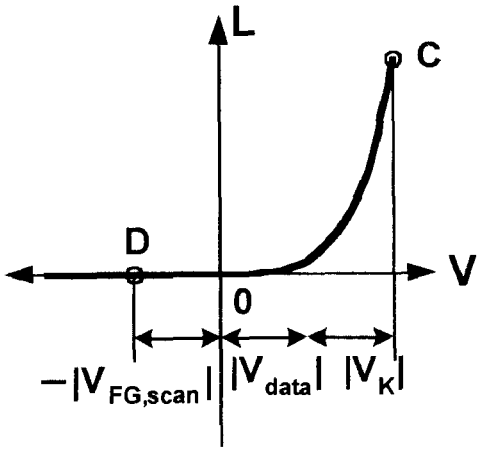
FIGS. 38A and 38B are schematic diagram showing luminance-voltage characteristics of a luminance modulation element.
Figure 38B:
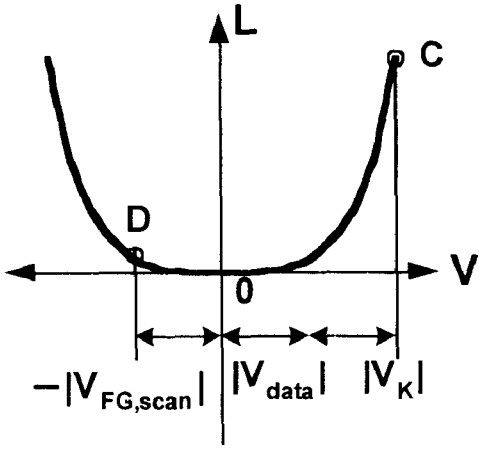

Unipolar luminance modulation elements will now be described in further detail. Luminance modulation elements having luminance-voltage characteristics shown in FIGS. 38A and 38B will now be considered. In the ensuing description, luminance modulation elements are assumed to be light-emitting elements. In FIGS. 38A and 38B, the vertical axis indicates luminance, i.e., brightness in the case of a light-emitting element, and the axis of abscissas indicates a voltage applied to the light-emitting element. In the characteristic of FIG. 38A, applying a voltage of positive polarity increases the luminance, whereas applying a voltage of negative polarity makes the luminance substantially equal to zero. In other words, the luminance modulation element having the characteristic of FIG. 38A is unipolar. On the other hand, in the case of FIG. 38B, the luminance is changed also when a voltage of negative polarity is applied. In other words, the luminance modulation element having the characteristic of FIG. 38B is bipolar.

It is now assumed that a matrix having N rows by M columns is formed of these luminance modulation elements, and the drive voltage waveforms corresponding to the equivalent circuit of FIG. 2 are applied; that is, the driving voltage waveforms, where the non-selected scanning lines are in a high impedance and the non-selected data lines are set at the ground potential., are applied. A scanning pulse having a negative voltage $V_K$ is applied to a selected row, resulting in a "half-selected" state. A data pulse having a positive voltage $V_{data}$ is applied to a data line of a luminance modulation element to be lit in the selected row. Therefore, a voltage of $V_{data}-V_K=|V_{data}|+|V_K|$ is applied to the luminance modulation element located at an intersecting point of the selected scanning line and the selected data line. As a result, the luminance modulation element becomes luminous (a point C in FIG. 38A or 38B).

At this time, the voltage $V_{FGscan}$ represented by the expression (6) is induced on scanning lines of the nonselection state. Therefore, a voltage of $-V_{FGscan}$ is applied to luminance modulation elements located at intersecting points of unselected scanning lines and unselected data lines (a point D in FIG. 38A or 38B). In the case of the bipolar luminance modulation element shown in FIG. 38B, it is made slightly luminous by the induced voltage of $-V_{FGscan}$ (the point D in FIG. 38B). In other words, unintended luminance modulation elements become luminous. As a result, a displayed image is disturbed. This is a problem caused in the case where unselected scanning lines are provided with a high impedance.

The present invention has solved this problem by using unipolar luminance modulation elements. In the case of the unipolar luminance modulation element shown in FIG. 38A, it does not become luminous even if the voltage of $-V_{FGscan}$ is applied thereto (the point D in FIG. 38A). Even if unselected scanning lines are provided with a high impedance, therefore, the displayed image is not disturbed.

In JP-A-57-22289, there is described such a drive method that AC inorganic electroluminescence elements, i.e., bipolar elements are used and unselected scanning lines are brought into a floating state. If unselected electrodes are brought into the floating state when there is used a half-select method in which a voltage required to make an element luminous is divided into the scanning pulse $V_K$ and the data pulse $V_{data}$ as described above, display errors occur. Therefore, a drive scheme which reduces the above described display errors, i.e., a full-select method is described. In this full-select method, a full-select pulse, i.e., a pulse having a voltage amplitude large enough to make an element luminous is applied to a selected data electrode, whereas a pulse having a voltage amplitude which is not large enough to make an element luminous is applied to unselected data electrodes.

On the other hand, according to the present invention, display errors can be prevented even in the half-select method, by using unipolar elements as luminance modulation elements.

By the way, in the foregoing description, the case where the scanning pulse has a negative voltage and the data pulse has a positive voltage has been described. It is a matter of course that completely the same is true of the opposite case where the scanning pulse has a positive voltage and the data pulse has a negative voltage. In this case as well, the expression (6) holds true, and the voltage $V_{FGscan}$ induced on the scanning electrode becomes a negative voltage. This is an opposite polarity for luminance modulation elements. If unipolar luminance modulation elements are used, therefore, display errors do not occur as described above.

Organic electroluminescence elements are called organic light-emitting diodes as well. The organic electroluminescence elements have such a diode characteristic that application of a forward voltage causes light emission, but application of a voltage of opposite polarity does not cause light emission. Organic electroluminescence elements are described in, for example, 1997 SID International Symposium Digest of Technical Papers, pp. 1073 to 1076 (published in May 1997). Organic electroluminescence elements of polymer type are described in 1999 SID International Symposium Digest of Technical Papers, pp. 372 to 375 (published in May 1999).

An example of luminance modulation elements including electron emission elements combined with a phosphor material is described in EURODISPLAY'90, 10th International Display Research Conference Proceedings (vde-verlag, Berlin, 1990), pp. 374 to 377. In this example, an electron emission element is formed of an electron emission emitter chip and a gate electrode for applying an electric field to the emitter chip. If a positive voltage relative to the emitter chip is applied to the gate electrode, electrons are emitted from the emitter chip to make the phosphor material luminous. If a negative voltage is applied, electrons are not emitted. In other words, the electron emission element is a unipolar luminance modulation element.

In the case where both unselected row electrodes and unselected column electrodes are set to the high impedance state, potentials $V_{FFscan}$ and $V_{FFdata}$ respectively induced on unselected row electrodes and unselected column electrodes are represented by the following expressions (7) and (8):

$$V_{FFscan} = \frac{\gamma N}{\gamma(N-1)+1}(V_{data} - V_K) + V_K \tag{7}$$

$$V_{FFdata} = \frac{\gamma(N-1)}{\gamma(N-1)+1}(V_{data} - V_K) + V_K \tag{8}$$

Figure 15A:
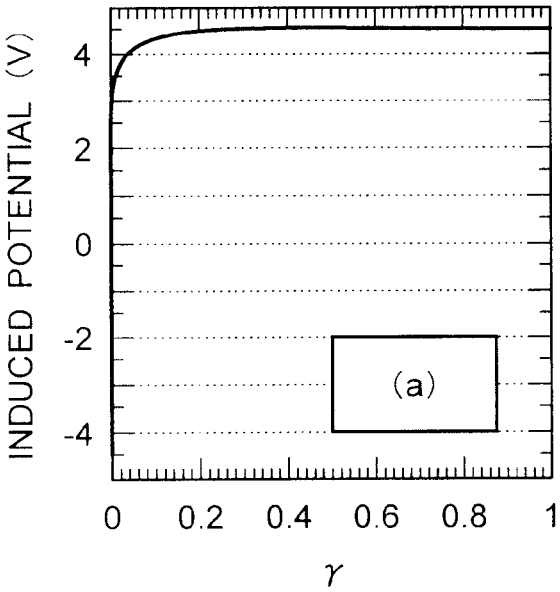
FIGS. 15A and 15B are diagrams showing an induced potential generated when each of unselected rows and unselected columns is provided with a high impedance.
Figure 15B:
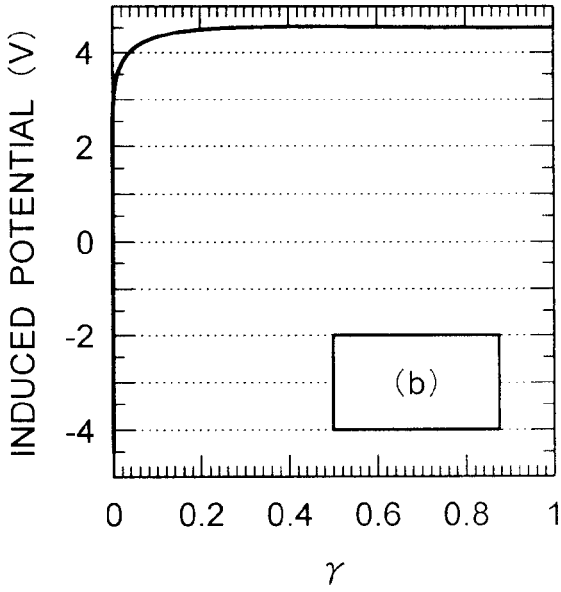

Results thereof are shown in FIGS. 15A and 15B. FIG. 15A shows the induced potential induced on an unselected row electrode. FIG. 15B shows the induced potential induced on an unselected column electrode. In FIGS. 15A and 15B, N=500, M=3000, $V_{data}$=4.5 V, and $V_K$=−4.5 V. γ=m/M is a ON ratio in one row. Both unselected row electrodes and unselected column electrodes have a negative potential in the vicinity of γ=0. As γ becomes large, the potential becomes positive. Denoting such a value of γ that the induced potential of an unselected row electrode becomes zero by $\gamma_0$, the $\gamma_0$ value is represented by the following expression (9):

$$\gamma_0 = \left[N\left(\frac{V_{data}}{-V_K}\right) + 1\right]^{-1} \tag{9}$$

Figure 16:
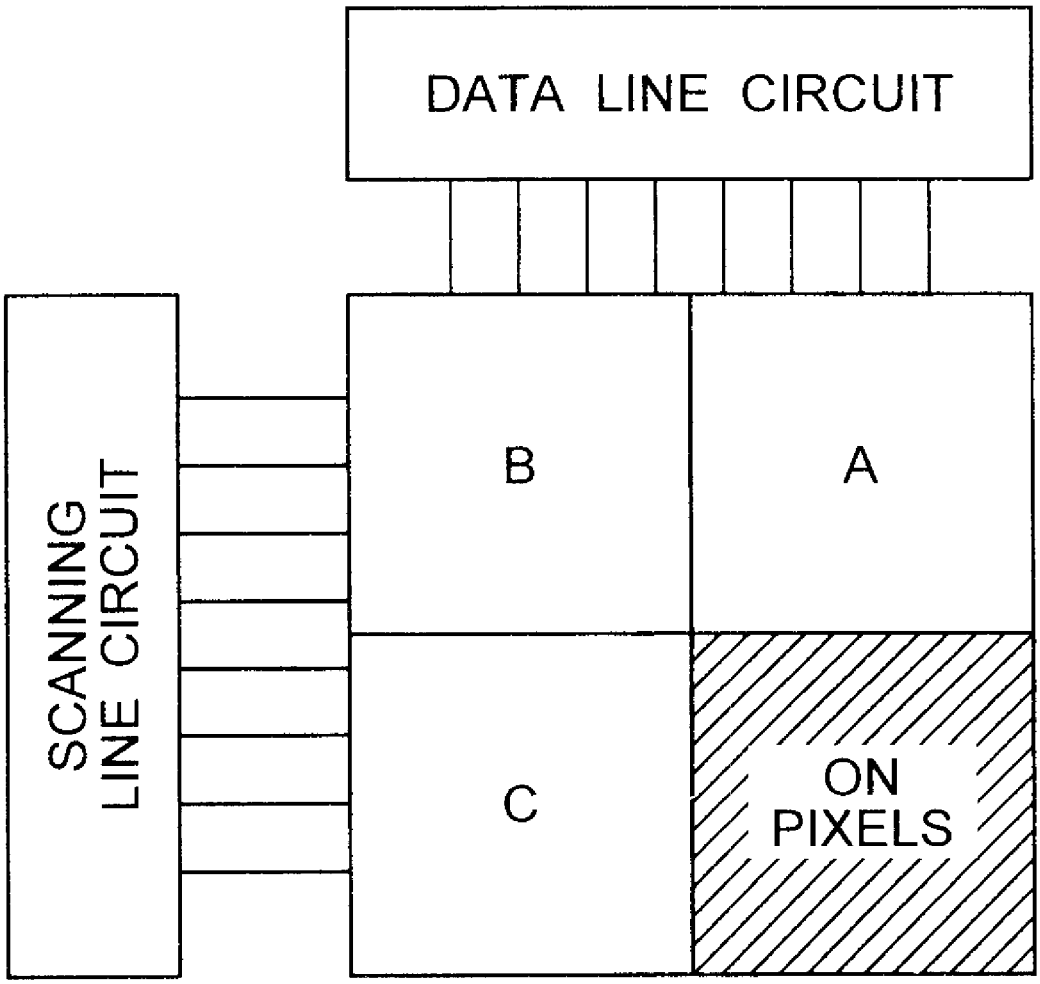
FIG. 16 is a diagram for investigating crosstalk occurring on the screen.

It is now assumed that only a lower right portion (the hatched region in FIG. 16) of the screen is lit, as depicted in FIG. 16. In a region B, both scanning lines and data lines are unselected. In the region B, therefore, the potential across luminance modulation elements is nearly zero, and consequently the luminance modulation elements do not become luminous. A region A is formed of combinations of unselected scanning lines and selected data lines. A large number of combinations occur during one field interval (field period). Therefore, the region A is a region in which crosstalk is apt to occur most. If $\gamma \geqq \gamma_0$, however, then the potential of unselected scanning lines becomes zero or a positive potential as evident from FIG. 15A, and consequently the voltage applied to luminance modulation elements becomes zero or has the opposite polarity. In the case where unipolar luminance modulation elements are used, therefore, crosstalk does not occur in the region A.

The condition $\gamma \geqq \gamma_0$ is satisfied by providing at least $\gamma_0$M luminance modulation elements or an element having the same capacitance ($\gamma_0$MCe) as a dummy element in each row and making the luminance modulation elements or the dummy element always on. The dummy element should be disposed in such a place that it is not visible from the outside.

A region C is formed of combinations of unselected data lines and selected scanning lines. If γ becomes large, a positive voltage is induced on each unselected column electrode as evident from FIG. 15B, and consequently a voltage of positive polarity is applied to each luminance modulation element. Therefore, there is a possibility that crosstalk will occur. In the region C, however, this combination occurs only once in one field interval. As a result, the influence of the crosstalk on the display image is comparatively slight.

Especially in the case where there are used luminance modulation elements which do not conduct luminance modulation (do not become luminous) unless a sufficient current is supplied from an external circuit, a sufficient current does not flow even if a forward voltage is applied via a high impedance, and consequently the luminance modulation elements do not modulate their luminance or do not become luminous. In the region C as well, therefore, crosstalk does not exert a great influence.

As luminance modulation elements having such a characteristic, there are a combination of a thin film electron emitter and a phosphor material, and organic electroluminescence elements.

In the foregoing example, the case where the data pulse is applied to dummy pixels has been described. The case where the dummy pixels are set to a fixed potential of a low impedance will now be described. It is now assumed that a dummy capacitance having a capacitance value of pCe which is equivalent to p pixels is provided on each row, and dummy capacitances are connected by a dummy column electrode to a fixed potential $V_G$.

Figure 32:
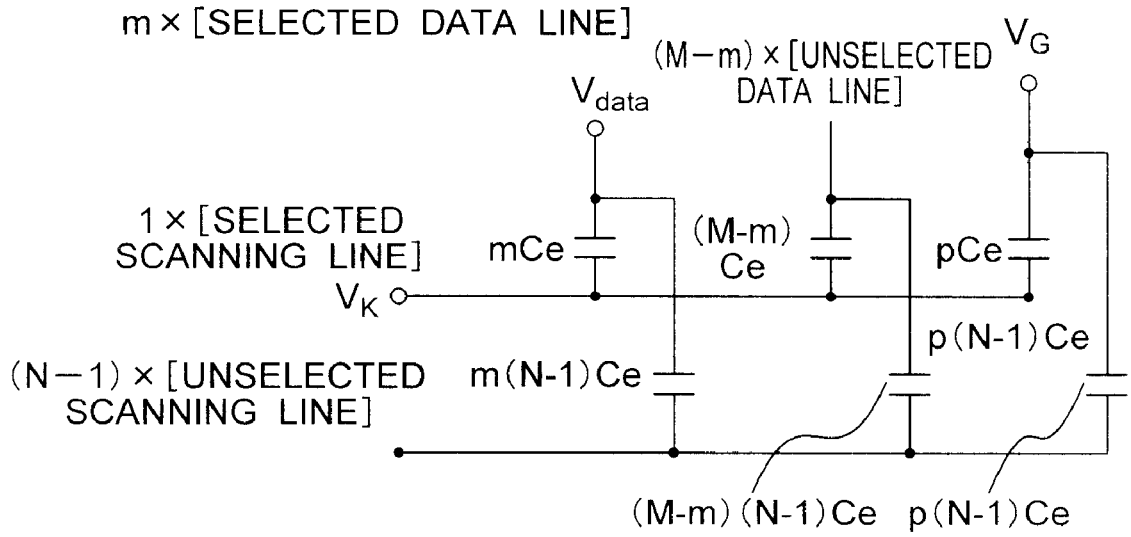
FIG. 32 is a diagram showing an equivalent circuit for calculating a capacitance between electrodes in a drive method of an image display apparatus according to the present invention.
Figure 33:
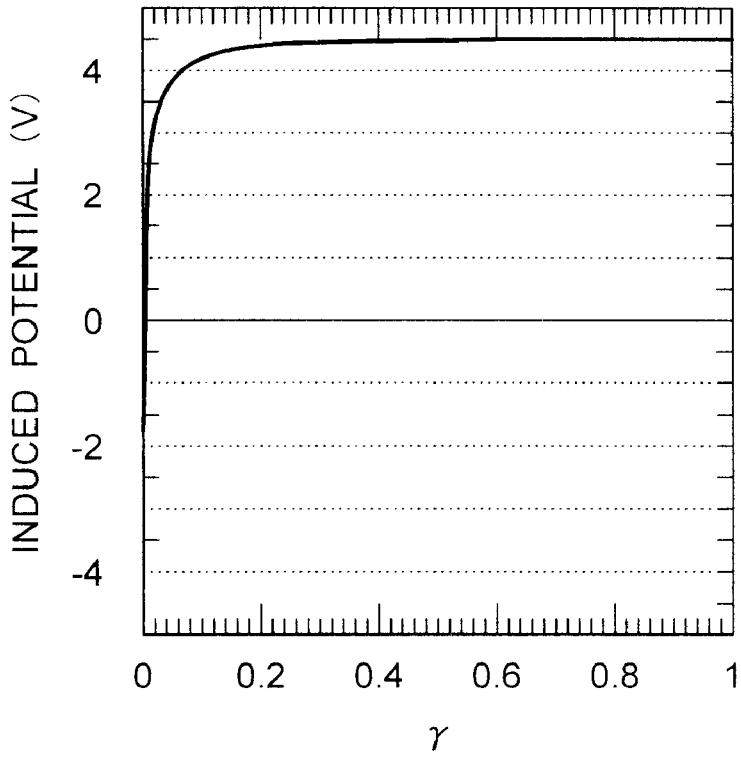
FIG. 33 is a diagram showing an induced potential generated when each of unselected rows and unselected columns is provided with a high impedance.

FIG. 32 shows an equivalent circuit of this case. It is assumed that selected scanning lines have a potential of $V_K$ and selected data lines have a voltage of $V_{data}$. At this time, unselected scanning lines have a potential represented by the following expression (10):

$$V_{FFscan} = \frac{\gamma(NV_{data} - V_K) + V_K + \alpha NV_G}{\gamma(N-1) + 1 + \alpha N} \tag{10}$$

where $\gamma$=m/M is a ON ratio in one row, and $\alpha$=p/M. FIG. 33 shows a result of calculation of the expression (10) conducted for the case where N=500, M=3000, $V_{data}=-V_K=4.5$ V and p=10. When compared with the case where the dummy capacitance is not added (FIG. 15A), there is little difference between them in the region of $\gamma \geqq 0.1$. On the other hand, there is a remarkable difference in the vicinity of $\gamma=0$. At $\gamma=0$, $V_{FFscan}=-4.5$ V in the case where the dummy capacitance is not added, whereas $V_{FFscan}=-1.7$ V in the case where the dummy capacitance is added. A negative value of $V_{FFscan}$ is a positive polarity for luminance modulation elements. Therefore, a smaller value of $V_{FFscan}$ brings about a great effect on reduction of crosstalk. As evident from this example, crosstalk can be reduced by adding a dummy capacitance corresponding to only 10 pixels (p=10) for M=3000.

A value of the dummy capacitance required for crosstalk reduction will now be estimated. Since $V_{FFscan}$ in the vicinity of $\gamma=0$ exerts influence upon crosstalk, the value of $V_{FFscan}$ should be reduced. The value of $V_{FFscan}$ at $\gamma=0$ can be derived by the following expression (11):

$$V_{FFscan}(\gamma = 0) = \frac{V_K + \alpha NV_G}{1 + \alpha N} \tag{11}$$

A ratio between the case where there is a dummy capacitance (p>0) and the case where there is no dummy capacitance (p=0) is calculated. A condition that this ratio $V_{FFscan}$ (p, $\gamma$=0)/$V_{FFscan}$ (p=0, $\gamma$=0) becomes $\beta$ or less is derived as represented by the following expression (12):

$$C_d = \alpha MC_e \geq \frac{MC_e}{N} \cdot \frac{1-\beta}{\beta - (V_G/V_K)} \tag{12}$$

Cd=pCe=$\alpha$MCe is the value of the dummy capacitance. For obtaining a sufficient crosstalk reduction effect, it is desirable to nearly make $\beta \leqq 0.7$. Therefore, it is desirable to set a dummy capacitance having a value which satisfies the relation of the following expression (13):

$$C_d \geq \frac{MC_e}{N} \frac{0.3}{0.7 - (V_G/V_K)} \tag{13}$$

Here, "fixed potential" means "fixed potential" in contrast to the floating potential. In other words, it indicates the state that the set value coincides with the potential on the actual line. It is essential that the state is a low impedance state. In other words, it is not necessarily meant that the potential is temporally fixed to a constant potential.

As a matter of fact, as evident from the contents described earlier, there is a crosstalk reducing effect both in the case where a data pulse having an amplitude $V_{data}$ is applied to the dummy capacitance and in the case where the dummy capacitance is kept at the fixed potential $V_G$. Therefore, it is evident that a similar crosstalk reducing effect is obtained even if the dummy capacitance is kept in a low impedance state of a potential other than $V_G$ or $V_{data}$.

Hereafter, embodiments of the present invention will be described in detail by referring to the drawing.

In all drawings for describing embodiments, components having the same function are denoted by like characters and repetitive description thereof will be omitted.

First Embodiment

A display apparatus of a first embodiment according to the present invention is formed by using a display panel in which luminance modulation elements of dots are formed of a combination of a thin film electron emitter matrix serving as an electron emission source and a phosphor material, and by connecting drive circuits to row electrodes and column electrodes of the display panel.

The thin film electron emitter is an electron emission element having such a structure that an electron acceleration layer such as an insulation layer is inserted between two electrodes (a top electrode and a base electrode). The thin film electron emitter emits hot electrons accelerated in an electron acceleration layer into a vacuum through the top electrode. As examples of the thin film electron emitter, there are known an MIM electron emitter formed of metal, insulator and metal; a ballistic electron surface emission element using porous silicon or the like for the electron acceleration layer (described in, for example, Japanese Journal of Applied Physics, Vol. 34, Part 2, No. 6A, pp. L705 to L707, 1995); and a thin film electron emitter using a semiconductor-insulator stacked film (described in, for example, Japanese Journal of Applied Physics, Vol. 36, Part 2, No. 7B, pp. L939 to L941, 1995). Hereafter, an example using the MIM electron emitter will be described.

Here, the display panel includes an electron-emitter plate on which a matrix of thin film electron emitter elements is formed, and a phosphor plate on which a phosphor pattern is formed.

Figure 6:
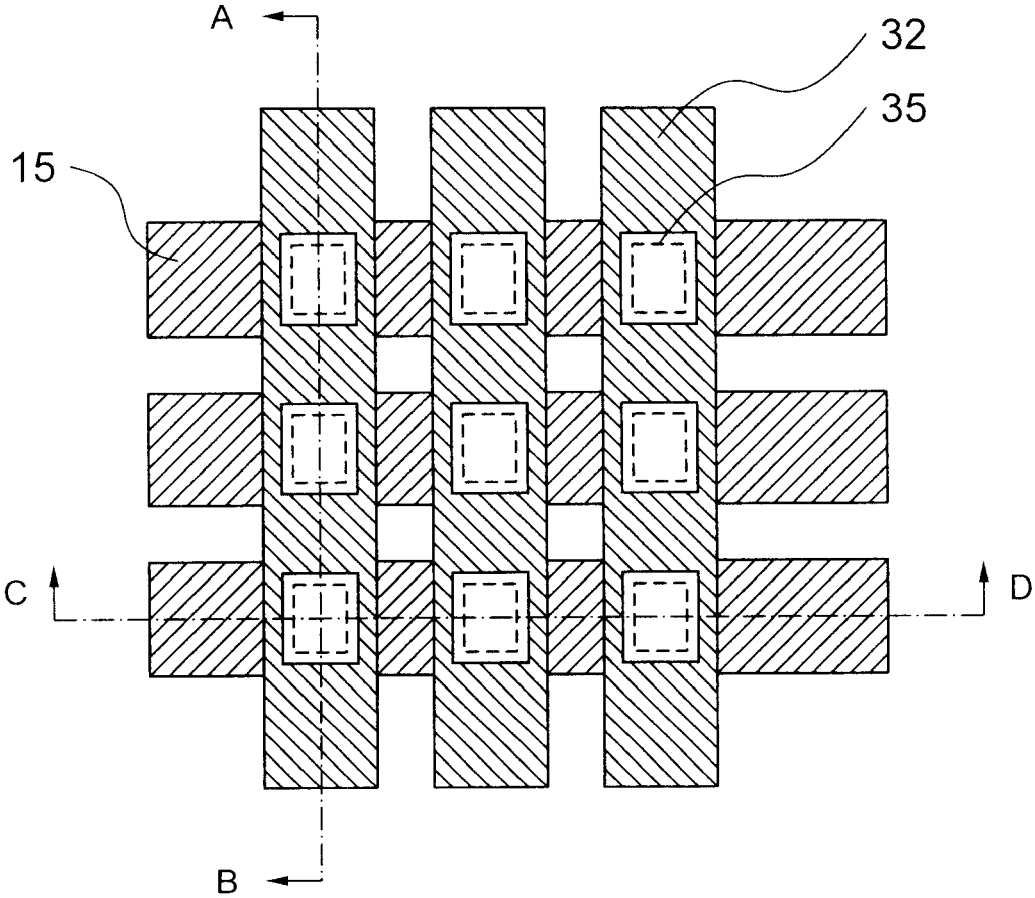
FIG. 6 is a top view showing a partial configuration of a thin film electron emitter matrix of an electron emitter plate in a first embodiment of the present invention.
Figure 7:
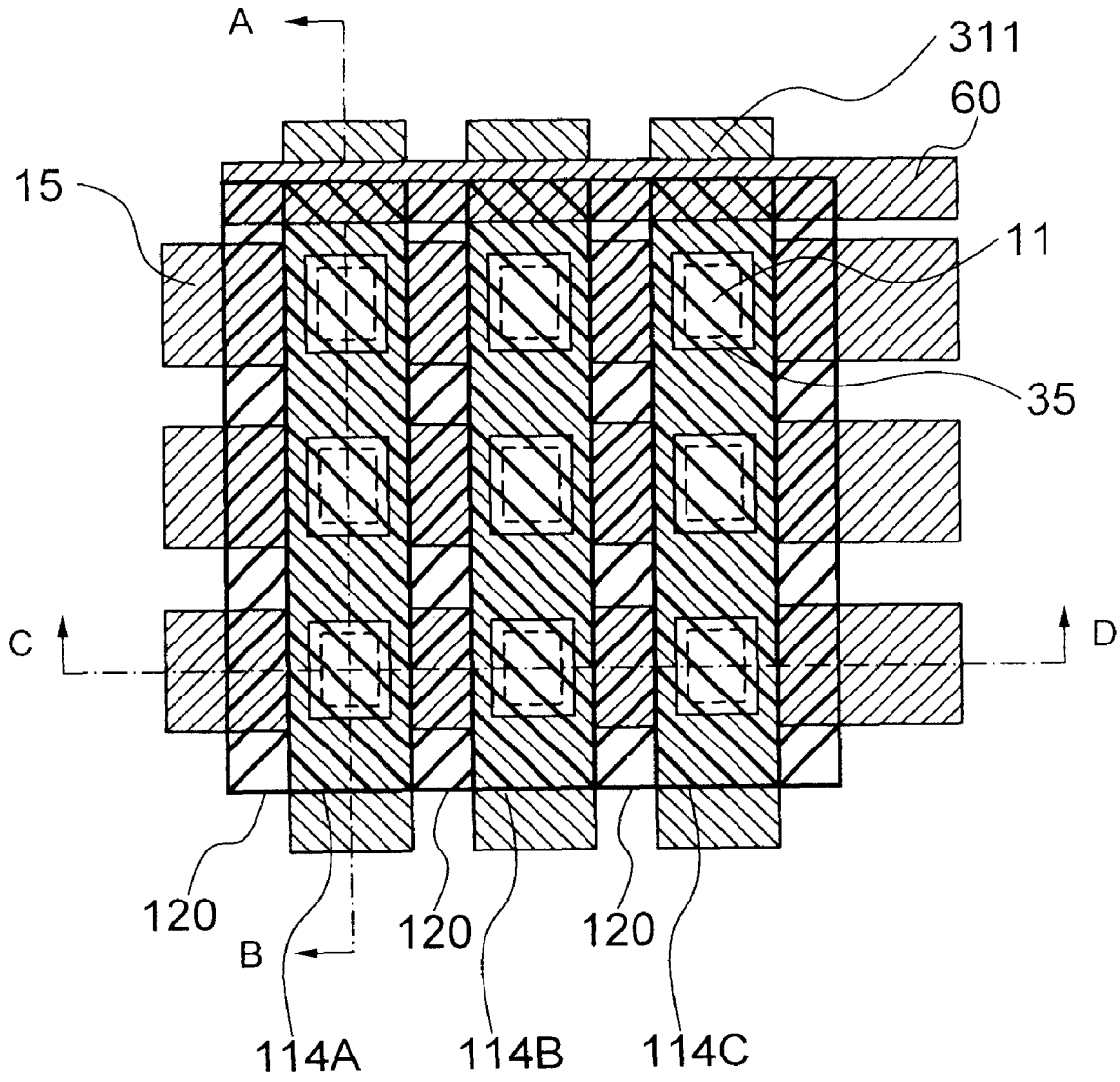
FIG. 7 is a top view showing a position relation between an electron emitter plate and a phosphor plate in a first embodiment of the present invention.

FIG. 6 is a top view showing a partial configuration of a thin film electron emitter matrix of an electron emitter plate of the present embodiment. FIG. 7 is a top view showing a position relation between an electron emitter plate and a phosphor plate.

Figure 8A:
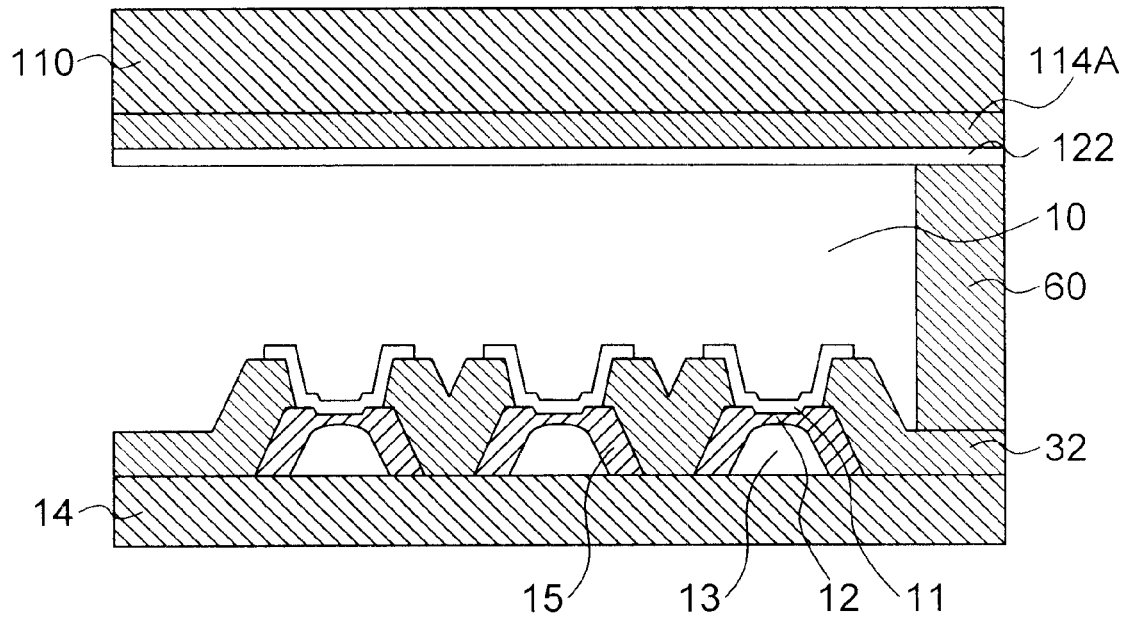
FIGS. 8A and 8B are sectional views of a principal part showing a configuration of an image display apparatus in a first embodiment of the present invention.
Figure 8B:
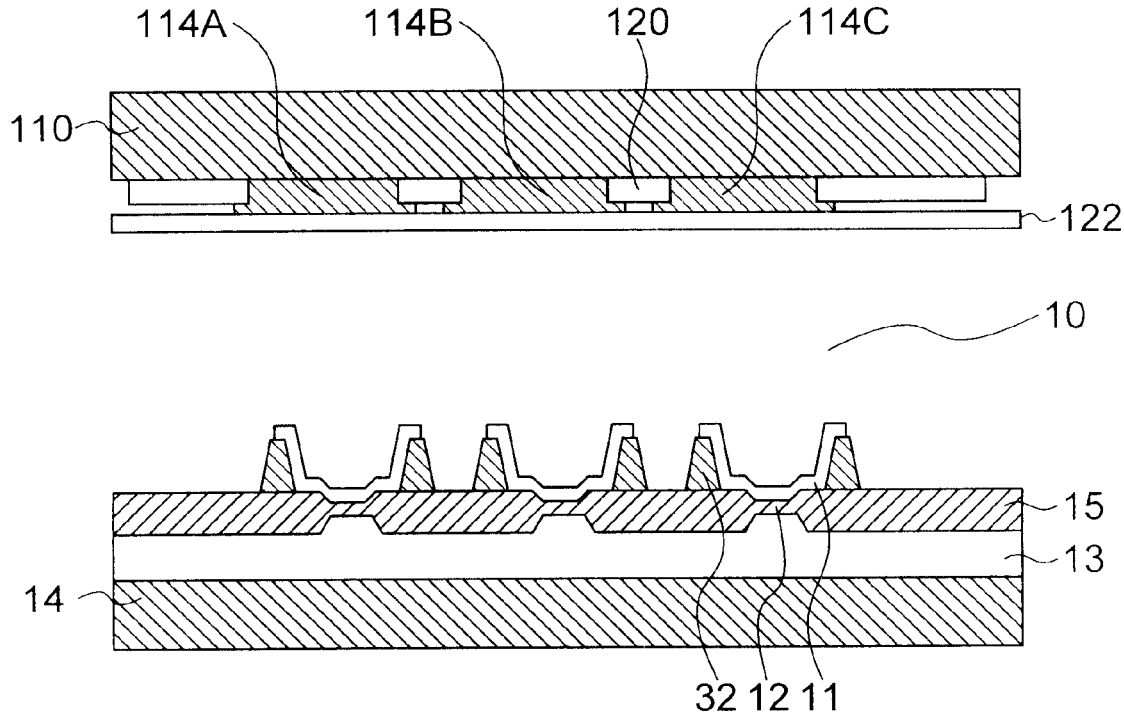

FIGS. 8A and 8B are sectional views of a principal part showing a configuration of an image display apparatus of the present embodiment. FIG. 8A is a sectional view taken along a cutting-plane line A-B shown in FIGS. 6 and 7. FIG. 8B is a sectional view taken along a cutting-plane line C-D shown in FIGS. 6 and 7. In FIGS. 6 and 7, illustration of a substrate 14 is omitted.

In FIGS. 8A and 8B, the drawing in the height direction is not to scale. That is, although a base electrode 13 and a top electrode bus line 32 have a thickness of several $\mu$m or less, the distance between the substrate 14 and a substrate 110 is in the range of approximately 1 to 3 mm.

In the ensuing description, an electron emitter matrix having three rows by three columns is used as an example. As a matter of course, however, the number of rows in the actual display panel is in the range of several hundreds to several thousands, and the number of columns becomes several thousands.

In FIG. 6, a region 35 surrounded by a broken line indicates an electron emission region of an electron emitter element of the present invention.

The electron emission region 35 is a place defined by a tunnel insulation layer 12. Electrons are emitted from the inside of the region into a vacuum.

Since the electron emission region 35 is covered by a top electrode 11, it does not appear in the top view. Therefore, the electron emission region 35 is indicated by the broken line.

FIGS. 9A to 9F are diagrams showing a fabrication method of the electron emitter plate of the present embodiment.

Hereafter, the fabrication method of a thin film electron emitter matrix in the electron emitter plate of the present embodiment will be described by referring to FIGS. 9A to 9F.

In FIGS. 9A to 9F, only one thin film electron emitter 301 formed at an intersecting point of one of the row electrodes 310 and one of the column electrodes 311 is taken out and drawn. As a matter of fact, however, a plurality of thin film electron emitters 301 are arranged in a matrix pattern as shown in FIGS. 6 and 7.

In each of FIGS. 9A to 9F, the right side is a top view whereas the left side is a sectional view taken along a line A-B shown in the top view.

On the insulative substrate 14 made of glass or the like, a conductive film for the top electrode 13 is formed so as to have a film thickness of, for example, 300 nm.

As the material of the top electrode 13, for example, aluminum (Al, hereafter referred to as Al) alloy can be used.

Here, an Al-neodymium (Nd, hereafter referred to as Nd) alloy is used.

For forming the Al alloy film, for example, the sputtering method or the resistance heating evaporation method is used.

Figure 9A:
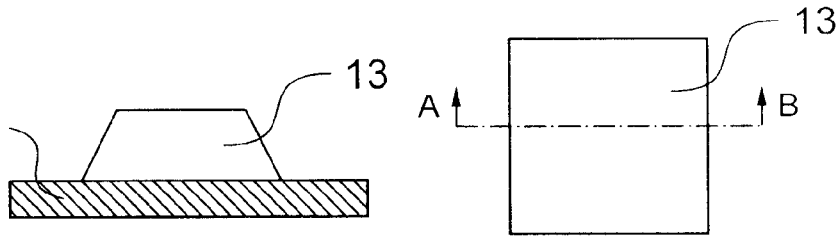
FIGS. 9A to 9F are diagrams showing a fabrication method of an electron emitter plate in a first embodiment of the present invention.

Subsequently, the Al alloy film is worked so as to form a stripe form, by means of resist formation using photolithography and subsequent etching. As shown in FIG. 9A, the top electrode 13 is thus formed. Here, the top electrode 13 serves also as the row electrode 310.

The resist used here may be any one so long as it is suitable for etching. As for etching as well, either of wet etching and dry etching can be used.

Figure 9B:
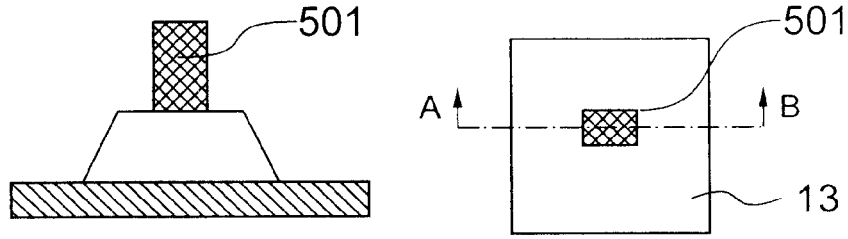

Subsequently, resist is applied and exposed to ultraviolet rays. Thus resist is subject to patterning, and a resist pattern 501 is formed as shown in FIG. 9B.

As the resist, a quinone diazide positive type resist is used.

Figure 9C:
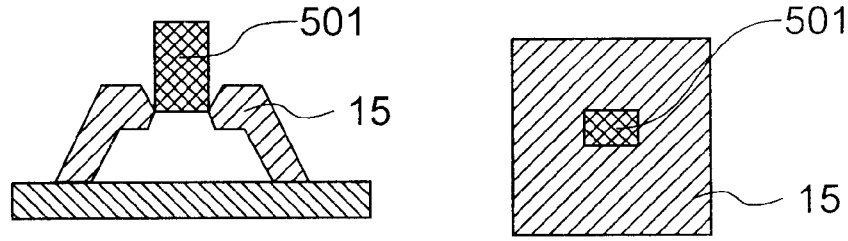

Subsequently, with the resist pattern 501 intact, anodic oxidation is conducted to form a protection insulation layer 15 as shown in FIG. 9C.

In the present embodiment, a anodizing voltage of approximately 100 V is used in the anodic oxidation, and the film thickness of the protection insulation layer 15 is set to approximately 140 nm.

Figure 9D:
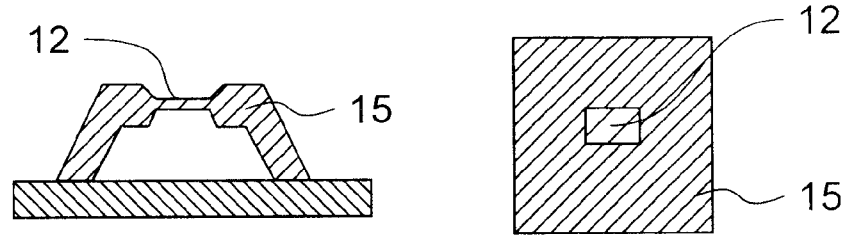

The resist pattern 501 is peeled off by an organic solvent such as acetone. Thereafter, the surface of the top electrode 13 which has been covered by the resist until then is anodized again. A tunnel insulation layer 12 is thus formed as shown in FIG. 9D.

In the present embodiment, the anodizing voltage is set equal to 6 V and the thickness of the tunnel insulation layer is set equal to 8 nm in the anodic oxidation of this time.

Figure 9E:
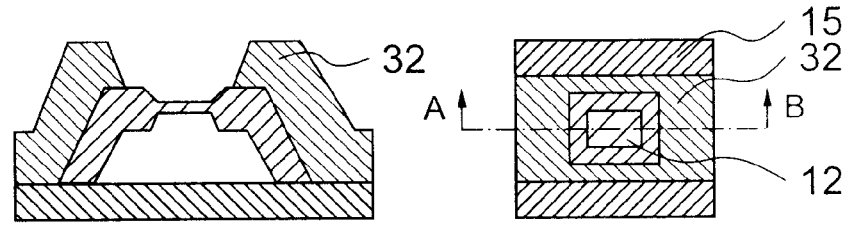

Subsequently, a conductive film for the top electrode bus line 32 is formed. A resist is patterned, and etching is conducted. As shown in FIG. 9E, a top electrode bus line 32 is formed.

In the present embodiment, an Al alloy is used as the top electrode bus line 32, and its film thickness is set equal to approximately 300 nm.

As the material of the top electrode bus line 32, gold (Au) may also be used.

The top electrode bus line 32 is etched so that the edges of the pattern will be tapered and the top electrode 11 formed later will not be broken by a step located at the edges of the pattern. Here, the top electrode bus line 32 serves also as the column electrode 311.

Subsequently, iridium (Ir) having a film thickness of 1 nm, platinum (Pt) having a film thickness of 2 nm, and gold (Au) having a film thickness of 3 nm are formed in the cited order by sputtering.

A laminated film of Ir—Pt—Au is patterned by patterning using a resist and etching. The top electrode 11 is thus formed as shown in FIG. 9F.

Figure 9F:
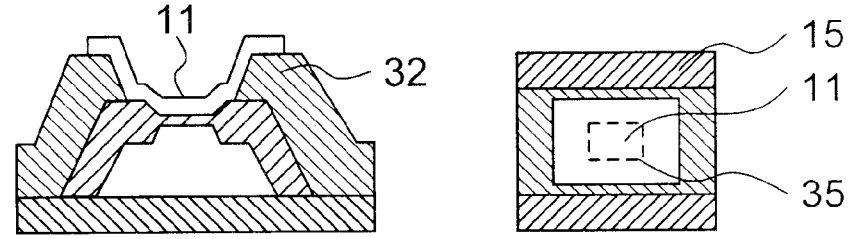

In FIG. 9F, the region 35 surrounded by a broken line indicates the electron emission region.

The electron emission region 35 is a place defined by the tunnel insulation layer 12. Electrons black matrix 120 and the components on the substrate, the components on the substrate 110 are represented by oblique lines only in FIG. 7.

The positional relation between the electron emission region 35, i.e., the portion in which the tunnel insulation layer 12 has been formed and the width of the phosphor material 114 is important.

In the present embodiment, design is conducted so as to make the width of the electron emission region 35 narrower than the width of the phosphor materials 114A to 114C, considering that an electron beam emitted from the thin film electron emitter 301 spreads out spatially somewhat.

The distance between the substrate 110 and the substrate 14 is set equal to a value in the range of approximately 1 to 3 mm.

The spacer 60 is inserted in order to prevent external force of the atmospheric pressure from breaking down the display panel when the inside of the display panel is evacuated.

In the case where a display apparatus having an width of at most approximately 4 cm by a length of at most approximately 9 cm in display area is fabricated by using glass having a thickness of 3 mm for the substrate 14 and the substrate 110, it is not necessary to insert the spacer 60 because the mechanical strength of the substrate 110 and the substrate 14 themselves can endure the atmospheric are emitted from the inside of the region into a vacuum.

By the process heretofore described, the thin film electron emitter matrix is completed on the substrate 14.

In the thin film electron emitter matrix, electrons are emitted from the region (the electron emission region 35) defined by the tunnel insulation layer, i.e., the region defined by the resist pattern 501 as described earlier.

In the peripheral part of the electron emission region 35, the protection insulation layer 15 which is a thick insulation film has already been formed. An electric field applied between the top electrode and the top electrode does not concentrate on sides or corners of the top electrode 13. A stable electron emission characteristic is obtained for many hours.

A phosphor plate of the present embodiment includes a black matrix 120 formed on a substrate 110 made of soda glass; red (R), green (G) and blue (B) phosphor materials 114A to 114C; and a metal-back film 122 formed on the phosphor materials.

Hereafter, a method for fabricating the phosphor plate of the present embodiment will be described.

First, for the purpose of increasing the contrast of the display apparatus, the black matrix 120 is formed on the substrate 110 (see FIG. 8B).

Subsequently, the red phosphor material 114A, the green phosphor material 114B, and the blue phosphor material 114C are formed.

Patterning of these phosphor materials is conducted by using photolithography in the same way as the phosphor screen of ordinary cathode ray tubes.

As the phosphor materials, for example, $Y_2O_2S$:Eu (P22-R), ZnS:Cu, Al (P22-G), and ZnS:Ag (P22-B) are used for red, green, and blue colors, respectively.

Subsequently, filming is conducted by using a film of nitrocellulose or the like. Thereafter, Al is evaporated on the entire substrate 110 so as to have a film thickness in the range of 50 to 300 nm. The metal-back film 122 is thus formed.

Thereafter, the substrate 110 is heated to approximately 400° C. The filming film and organic materials such as PVA are thus decomposed by heating. In this way, the phosphor plate is completed.

A spacer 60 is inserted between the electron emitter plate and the phosphor plate thus fabricated. They are sealed by using frit glass.

The position relation between the phosphor materials 114A to 114C and the thin film electron emitter matrix of the electron emitter plate is shown in FIG. 7.

In order to indicate the position relation between the phosphor materials 114A to 114C or the pressure.

The spacer 60 takes the shape of, for example, a rectangular parallelepiped as shown in FIG. 7.

Here, pillars of the spacer 60 are provided every three rows. So far as the mechanical strength endures, however, the number of the pillars (arrangement density) may be decreased.

The spacer 60 is made of glass or ceramic. Sheet-shaped or pillar-shaped pillars are arranged and disposed.

The sealed display panel is evacuated to a vacuum of approximately $1\times10^{-7}$ Torr, and sealed.

In order to keep a high degree of vacuum in the display panel, formation of a getter film or activation of a getter material is conducted in a predetermined position (not illustrated) in the display panel immediately before or after the tip-off.

In the case of a getter material containing, for example, barium (Ba) as the principal ingredient, the getter film can be formed by using radio frequency induction heating.

In this way, the display panel using the thin film electron emitter matrix is completed.

In the present embodiment, the distance between the substrate 110 and the substrate 14 is as large as approximately 1 to 3 mm. Therefore, acceleration voltage applied to the metal-back film 122 can be made as high as 3 to 6 kV. As described before, therefore, a phosphor material for cathode ray tube (CRT) can be used for the phosphor materials 114A to 114C.

Figure 10:
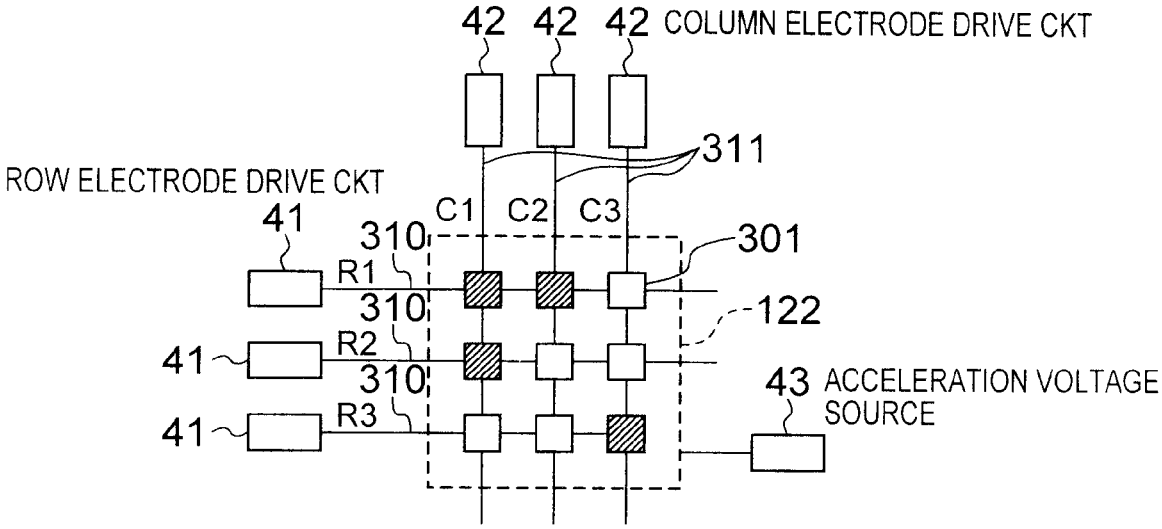
FIG. 10 is a connection diagram showing such a state that drive circuits are connected to a display panel of a first embodiment of the present invention.

FIG. 10 is a connection diagram showing such a state that drive circuits are connected to the display panel of the present embodiment.

The row electrodes 310 (which coincide with the top electrodes 13 in the present embodiment) are connected to the row electrode drive circuits 41, and the column electrodes 311 ((which coincide with the top electrode bus lines 32 in the present embodiment) are connected to the column electrode drive circuits 42.

Connection between each of the drive circuits 41 and 42 and the electron emitter plate is conducted by, for example, connecting tape carrier packages with an anisotropic conductive film or using the chip-on-glass technique. In the chip-on-glass technique, semiconductor chips forming respective drive circuits 41 and 42 are mounted directly on the substrate 14 of the electron emitter plate.

The metal-back film 122 is always supplied with an acceleration voltage in the range of approximately 3 to 6 kV from an acceleration voltage source 43.

Figure 11:
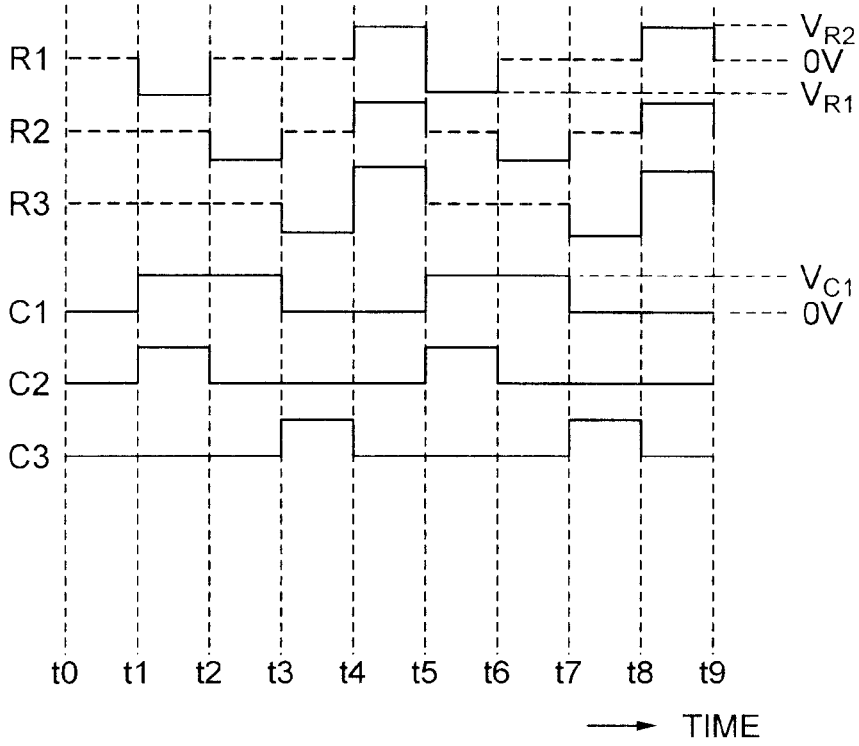
FIG. 11 is a timing chart showing an example of waveforms of drive voltages outputted from each of the drive circuits shown in FIG. 10.
Figure 12:
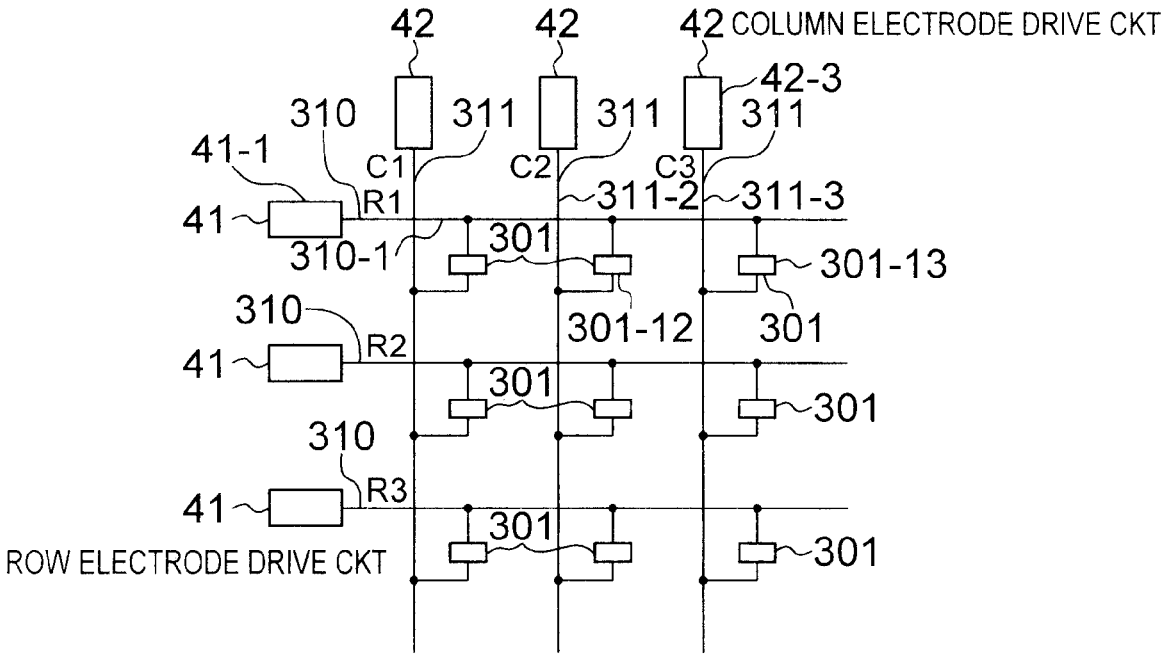
FIG. 12 is a diagram showing a schematic configuration of a conventional image display apparatus formed of a luminance modulation element matrix.
Figure 13:
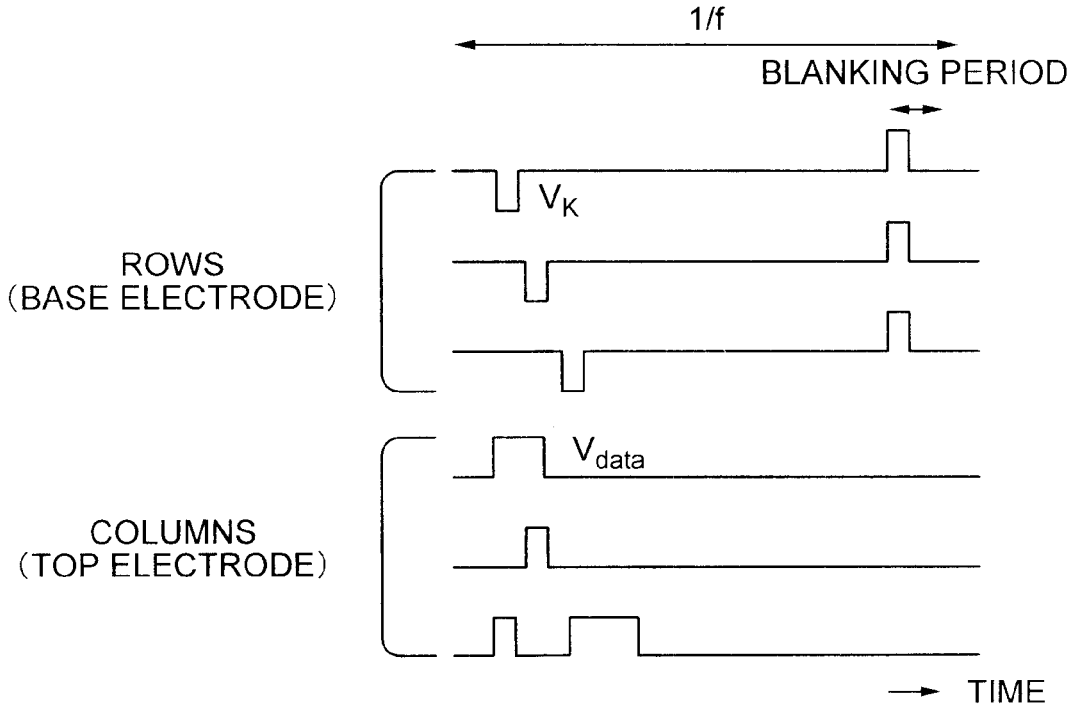
FIG. 13 is a diagram showing a drive method of a conventional image display apparatus.

FIG. 11 is a timing chart showing an example of waveforms of drive voltages outputted from respective drive circuits shown in FIG. 10.

In FIG. 11, each of broken lines represents a high impedance output state.

Practically, the output impedance needs to be in the range of approximately 1 to 10 MΩ. In the present embodiment, the output impedance is set equal to 5 MΩ.

Let an n-th row electrode 310 be Rn, and an m-th column electrode 311 be Cm. Let a dot at an intersecting point of the n-th row electrode 310 and the m-th column electrode 311 be (n, m).

At time t0, all the electrode are zero in voltage, and consequently electrons are not emitted. As a result, the phosphor materials 114A to 114C do not become luminous.

At time t1, a drive voltage of $V_{R1}$ is applied from a row electrode drive circuit 41 to a row electrode (310) R1, and a drive voltage of $V_{C1}$ is applied from a column electrode drive circuit 42 to column electrodes (311) C1 and C2.

Between the top electrode 11 and the top electrode 13 of each of dots (1, 1) and (1, 2), a voltage of $V_{C1}-V_{R1}$ is applied. If the voltage $V_{C1}-V_{R1}$ is set equal to or larger than an electron emission start voltage, therefore, electrons are emitted from thin film electron emitters of the two dots into the vacuum.

In the present embodiment, the voltages are set as $V_{R1}=-4.5$ V, and $V_{C1}=4.5$ V.

Emitted electrons are accelerated by a voltage applied to the metal-back film 122. Thereafter, the electrons bombard the phosphor materials 114A to 114C and make the phosphor materials 114A to 114C luminous.

For this interval, row electrodes 310 of remaining R2 and R3 are in the high impedance state. Irrespective of the voltage value of the column electrodes 311, therefore, electrons are not emitted and corresponding phosphor materials 114A to 114C do not become luminous.

At time t2, the drive voltage $V_{R1}$ is applied from a row electrode drive circuit 41 to the row electrode (310) R2, and the drive voltage $V_{C1}$ is applied from a column electrode drive circuit 42 to the column electrode (311) C1. As a result, a dot (2, 1) is lit. If drive voltage of voltage waveforms shown in FIG. 11 are applied to the row electrodes 310 and column electrodes 311, only shaded dots of FIG. 10 are lit. In this way, a desired image or information can be displayed by changing signals applied to the column electrodes 311.

Furthermore, by suitably changing the magnitude of the drive voltage VC1 applied to the column electrodes 311 according to an image signal, an image having a gray scale can be displayed.

In order to release the charge stored in the tunnel insulation layer 12, a voltage of $V_{R2}$ is applied from the row electrode drive circuits 41 to all row electrodes 310 at time t4 shown in FIG. 11. At the same time, a drive voltage of 0 V is applied from the column electrode drive circuits 42 to all column electrodes. Since $V_{R2}=2$ V, a voltage of $-V_{R2}=-2$ V is applied to the thin film electron emitters 301.

By thus applying a voltage (reverse pulse) having a polarity opposite to that at the time of electron emission, the life characteristic of the thin film electron emitters can be improved.

By the way, if vertical blanking period of a video signal are used as the intervals for applying reverse pulses (the interval between t4 and t5 and the interval between t8 and t9), favorable conformity to video signals is obtained.

In FIG. 11, the output waveform of the row electrode drive circuit 41 connected to the row electrode (310) R1 is switched over to the high impedance output at the time t2. As a matter of fact, however, switchover of the voltage $V_{R1}$ to 0 V of a low impedance is conducted immediately before the time t2, and thereafter switchover to a high impedance output is conducted.

Figure 17:
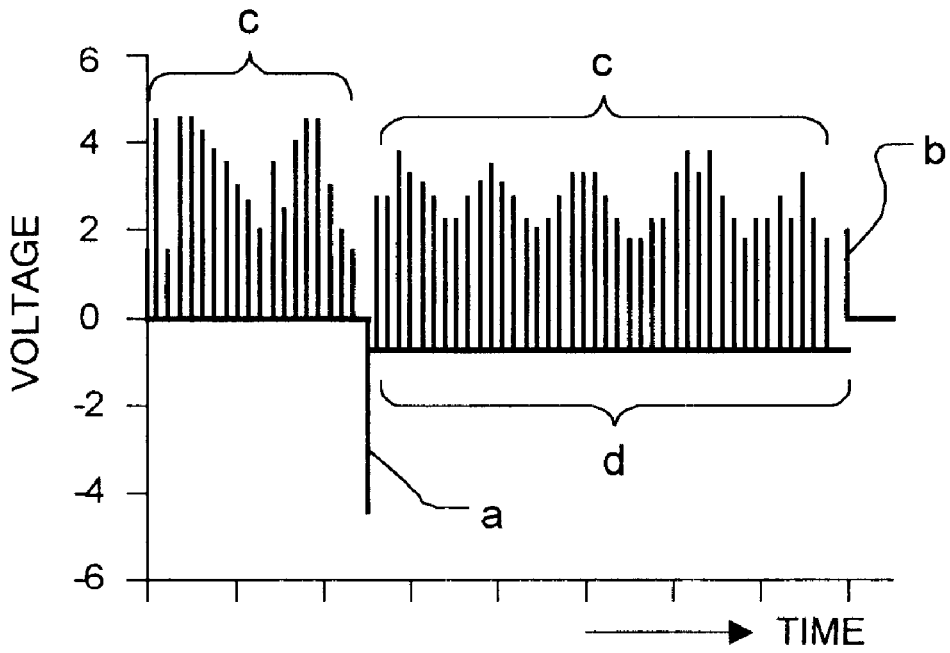
FIG. 17 is a diagram showing a result of observation of an induced potential induced on a row electrode in a first embodiment.

FIG. 17 shows a voltage waveform appearing on a certain row electrode 310 at the time of operation. FIG. 17 shows an waveform observed with a thin-film electron emitter matrix having 60 row electrodes 310 and 60 column elecltrodes 311. In FIG. 17, one horizontal division corresponds to 2 ms and one vertical division corresponds to 2 V. The pulse of negative polarity (a in FIG. 17) is a scanning pulse, and a pulse of positive polarity (b in FIG. 17) on the right side of FIG. 17 is the reverse pulse. Other appearing pulses of positive polarity (c in FIG. 17) are induced potentials induced in the high impedance interval. Since the pulses of positive polarity are the opposite polarity for the thin film electron emitters as described earlier, electron emission does not occur. On the other hand, in an interval (d in FIG. 17) lasting from application of the scanning pulse until application of the reverse pulse, voltages of negative polarity are induced. They are the influence of application of scanning pulses of negative polarity, and induced potentials caused by applying scanning pulses to adjacent row electrodes 310. The negative induced potentials are forward polarity for the thin film electron emitters. However, the negative induced potentials are approximately 0.8 V, and they are less than the electron emission threshold value. As a result, crosstalk does not occur in the displayed image.

As heretofore described, unselected row electrodes 310 are set to the high impedance state in the present embodiment. As described earlier, therefore, it becomes possible to reduce the power consumption.

Second Embodiment

A display panel used in a display apparatus of a second embodiment of the present invention, and a connection method between the display panel and drive circuits are the same as those of the first embodiment.

Figure 18:
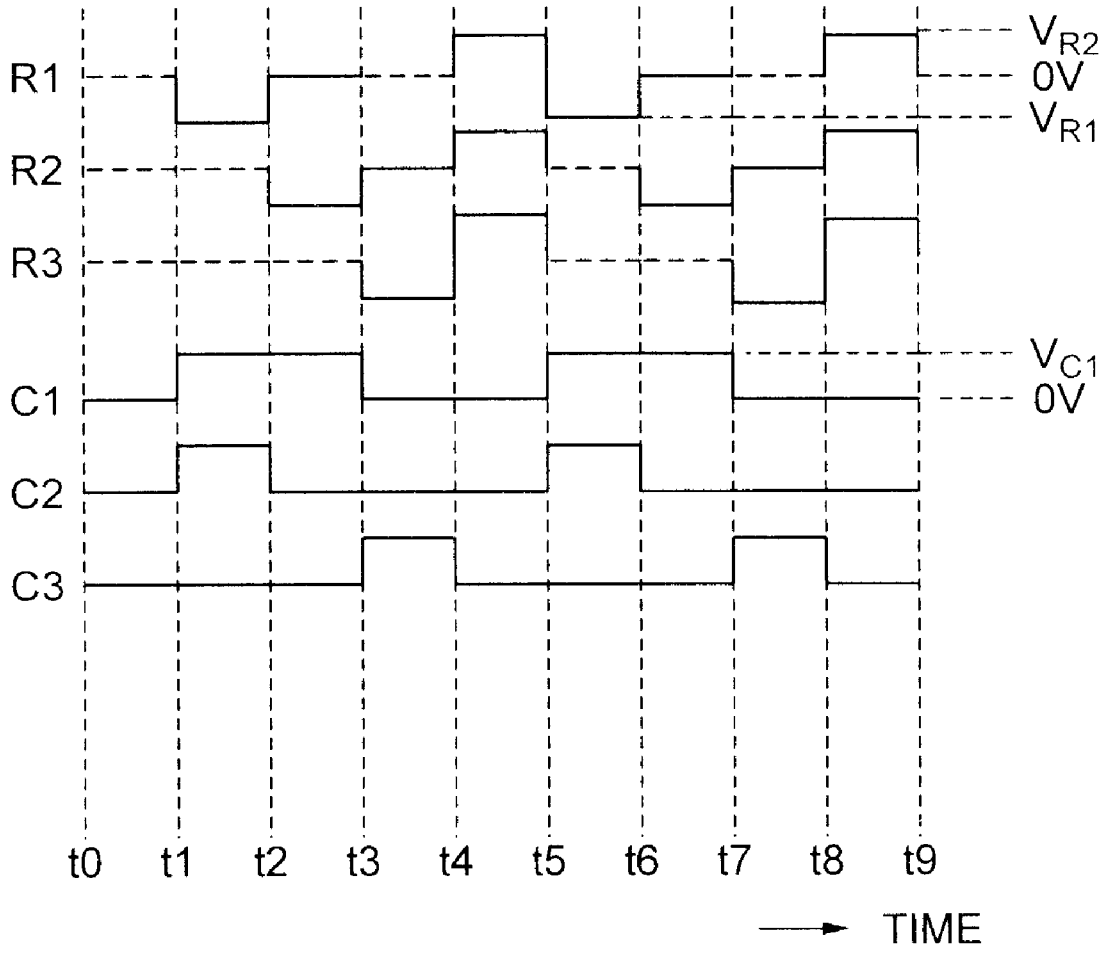
FIG. 18 is a diagram showing a part of drive voltage waveforms in an image display apparatus of a second embodiment of the present invention.

FIG. 18 is a timing chart showing an example of waveforms of drive voltages outputted from the row electrode drive circuits 41 and the column electrode drive circuits 42 in a display apparatus of a second embodiment of the present invention.

In an interval between time t1 and time t2, a scanning pulse having a potential of $V_{R1}$ is applied to the row electrode (310) R1. Thereafter, in an interval between time t2 and time t3, a scanning pulse is applied to the row electrode (310) R2 to control electron emission of a thin film electron emitter located on the row electrode (310) R2. At this time, the adjacent row electrode (310) R1 is connected to the ground potential via a low impedance instead of the high impedance. Also when applying a scanning pulse to the row electrode (310) R3 in the interval between time t3 and t4, the adjacent row electrode (310) R2 is connected to the ground potential via a low impedance. Except for them, the second embodiment is the same as the first embodiment.

Figure 19:
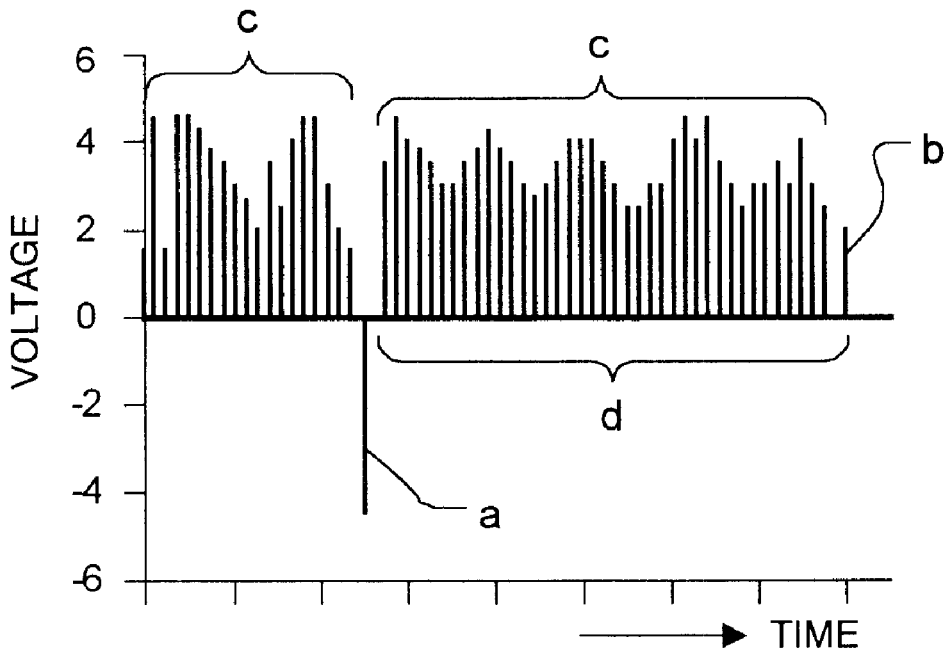
FIG. 19 is a diagram showing a result of observation of an induced potential induced on a row electrode in a second embodiment.

FIG. 19 shows a voltage waveform appearing on a certain row electrode 310 at the time of operation. FIG. 19 shows a waveform observed with a thin film electron emitter matrix having 60 row electrodes 310 and 60 column electrodes 311. The voltage waveform is nearly the same as that of FIG. 17. However, whereas in FIG. 17 voltages of negative polarity is induced immediately after the scanning pulse (a in FIG. 17) is applied (period d), the voltage of negative polarity is not induced in FIG. 19 during the period d. This is because an adjacent row is connected to the ground potential of the low impedance and consequently voltage induction caused by capacitance coupling between adjacent rows does not occur. As described earlier, the induced voltage of negative polarity is forward in polarity for thin film electron emitters. Therefore, it will be appreciated that the present embodiment is such a system that crosstalk is less liable to occur.

Figure 20:
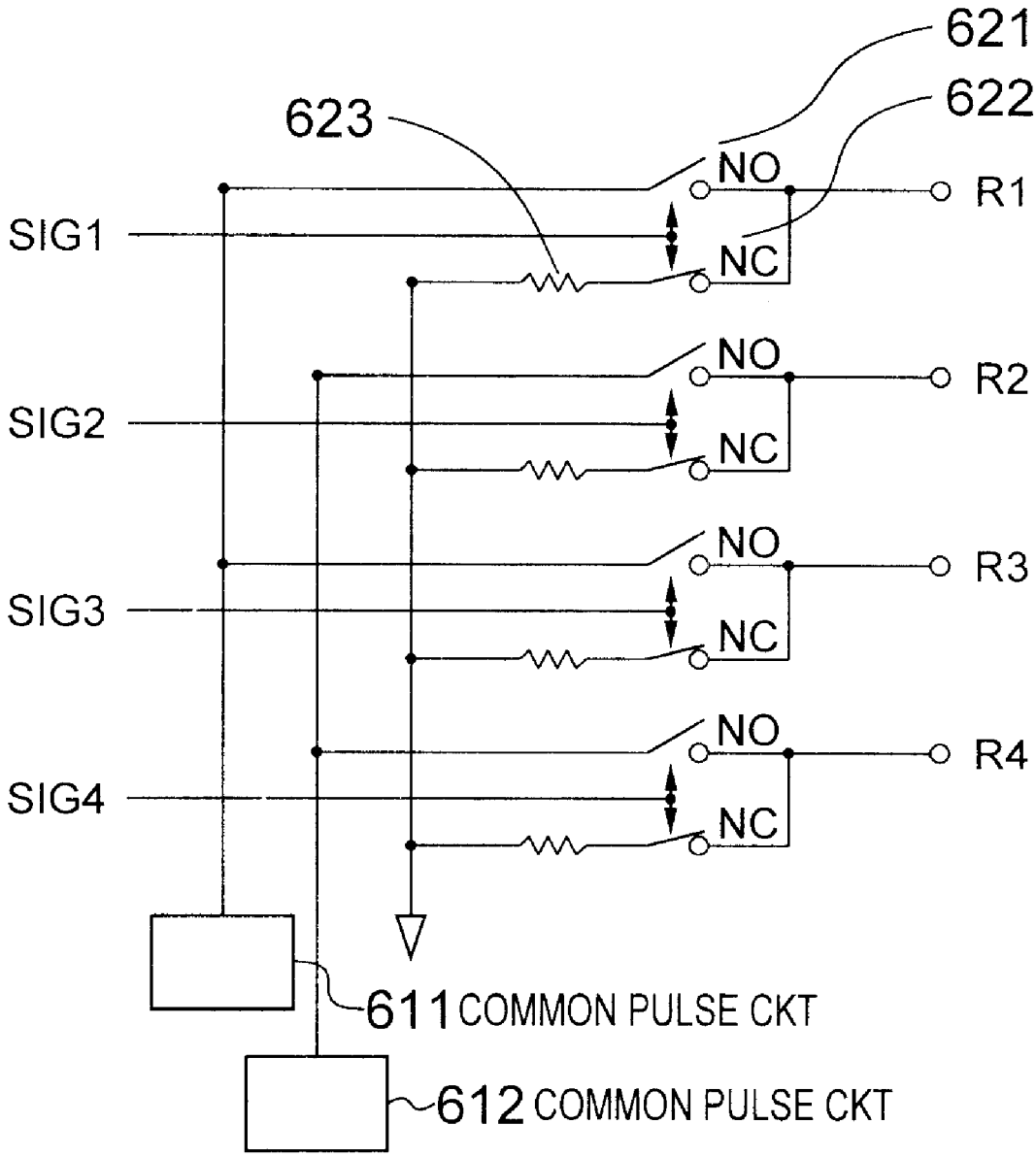
FIG. 20 is a diagram showing an example of a configuration of drive circuits in a second embodiment of the present invention.

An example of a scheme of drive circuits implementing the voltage waveforms of scanning pulses shown in FIG. 18 will now be described by referring to FIGS. 20 and 21. FIG. 20 is a circuit configuration diagram of row electrode drive circuits. The present circuit includes analog switches corresponding to respective output voltages R1, R2, R3 and R4, and common pulse circuits 611 and 612 for supplying a pulse voltage to these analog switches. The common pulse circuit A 611 is connected to analog switches corresponding to odd-numbered row electrodes. The common pulse circuit B 612 is connected to analog switches corresponding to even-numbered row electrodes.

Figure 21:
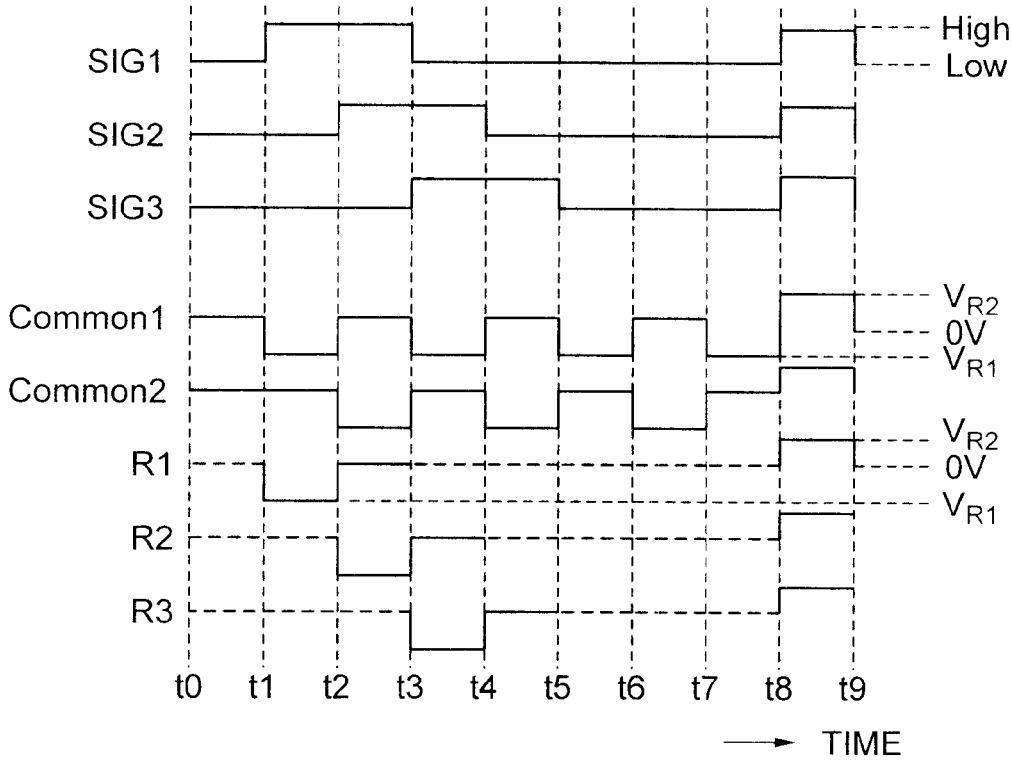
FIG. 21 is a timing chart showing operation of drive circuits of FIG. 20.

FIG. 21 shows signal voltage waveforms for controlling the circuit of FIG. 20. When an analog switch control signal SIG1 is in the high state, an output (Common1 in FIG. 21) of the common pulse circuit A 611 is outputted to the row electrode R1. When SIG1 is in the low state, the row electrode R1 is connected to the ground potential via an output resistor 623, resulting in a high impedance state. In the present embodiment, the output resistor 623 is set equal to 5 M Ω. In the same way, when an analog switch control signal SIG2 is in the high state, an output (Common2 in FIG. 21) of the common pulse circuit B 612 is outputted to the row electrode R2. When SIG2 is in the low state, the row electrode R2 is connected to the ground potential via an output resistor 623, resulting in a high impedance state.

Therefore, voltage waveforms outputted to respective row electrodes R1, R2 and R3 become as shown in R1, R2 and R3 of FIG. 21. A feature of this circuit scheme is that common pulse circuits are divided into the circuit 611 for odd-numbered row electrodes and the circuit 612 for even-numbered row electrodes and the circuits are made to output pulse voltages differing in phase. By doing so, it is possible to easily form a circuit that provides the ground potential of low impedance only for such an interval that a scanning pulse is applied to an adjacent scanning pulse.

In an interval between times t8 and t9, a reverse pulse is outputted to every R−n (where n is an integer) by making every SIG−n (where n is an integer) high and outputting a pulse of positive polarity from each common pulse circuit.

Third Embodiment

A configuration of a display panel used in an image display apparatus of a third embodiment according to the present invention will now be described by referring to FIG. 22.

A display panel used in the present embodiment is almost the same as that of the first embodiment. As shown in FIG. 22, however, the display panel used in the present embodiment differs from that of the first embodiment in that thin film electron emitter elements are formed as dummy pixels 303. The number of columns in which thin film electron emitter elements are formed as dummy pixels 303 is made larger than $\gamma_0 M$, where $\gamma_0$ is a $\gamma_0$ value represented by the expression (9). The dummy pixels 303 are formed between every row electrode 310 and each of the dummy column electrodes 313. Each of the dummy column electrodes 313 is connected to a dummy column electrode drive circuit 45.

Figure 22:
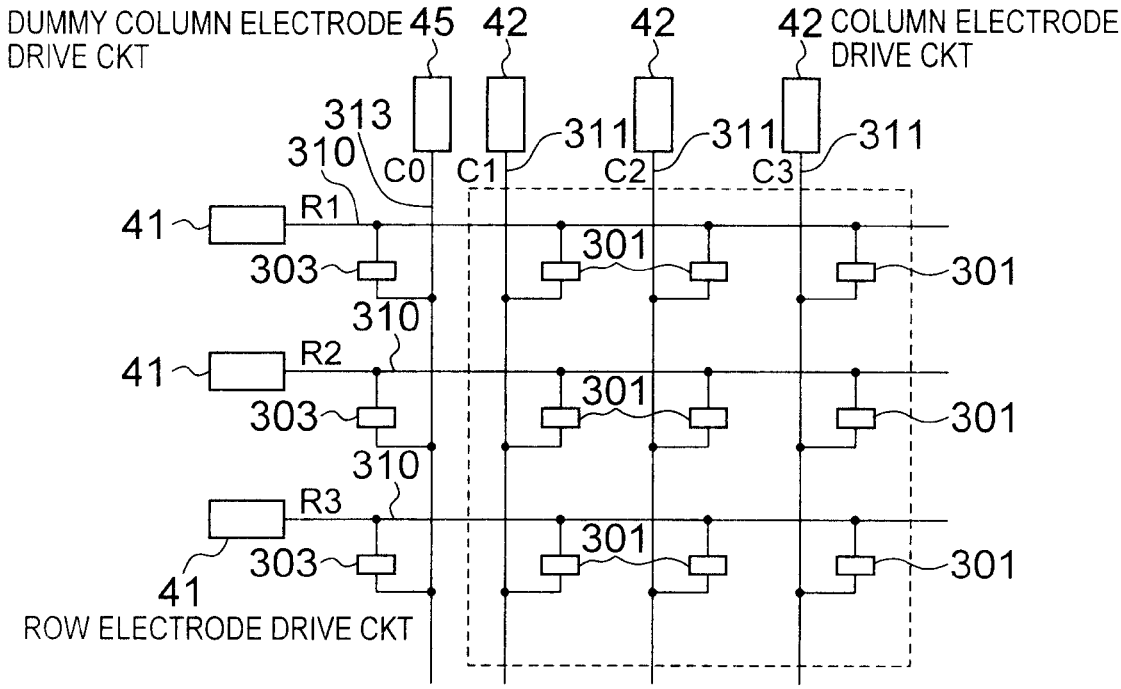
FIG. 22 is a diagram showing a configuration of an image display apparatus in a third embodiment of the present invention and showing connections of the image display apparatus to drive circuits.

However, phosphor materials 114 on a phosphor plate are formed in a region corresponding to a region surrounded by a broken line in FIG. 22. In other words, phosphor materials are not formed in the portion corresponding to the dummy pixels 303. Even if electrons are emitted from thin film electron emitters of the dummy pixels 303, therefore, the dummy pixels do not become luminous. As a result, the display image is not affected at all.

Instead of using thin film electron emitter elements, a capacitance greater than $\gamma_0 MCe$ may be formed in each of dummy columns as dummy pixels 303. In this case as well, the dummy column electrode drive circuit 45 is connected to the capacitance.

Figure 23:
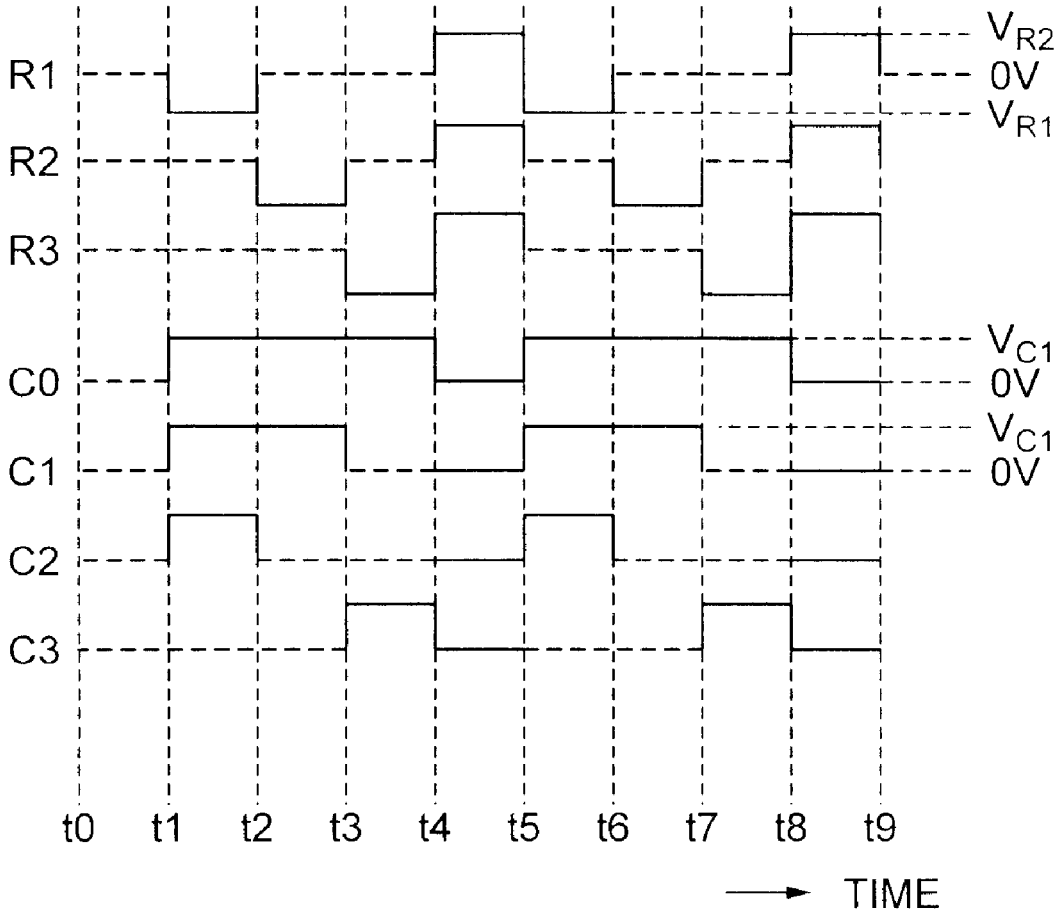
FIG. 23 is a diagram showing a part of drive voltage waveforms in an image display apparatus of a third embodiment of the present invention.

FIG. 23 is a diagram showing drive voltage waveforms in the present embodiment.

FIG. 23 is a timing chart showing an example of waveforms of drive voltages outputted from row electrode drive circuits 41, column electrode drive circuits 42, and the dummy column electrode drive circuit 45.

In an interval between time t1 and time t2, dots (R1, C1) and (R1, C2) are made luminous by applying a scanning pulse having a potential of VR1 to the row electrode (310) R1 and, in addition, applying a data having a potential of VC1 to column electrodes (311) C1 and C2, in the same way as the first embodiment. In the present embodiment, however, a column electrode (311) C3 corresponding to an unluminous dot (R1, C3) is set to the high impedance state. By doing so, the dissipation power can be further reduced as described earlier.

Furthermore, in the present embodiment, the data pulse is always applied from the dummy column electrode drive circuit 45 as represented by a waveform of C0 in FIG. 23. Therefore, the expression (9) is always satisfied. As a result, occurrence of crosstalk can be prevented. As described earlier, the operation state of the dummy pixels 303 does not affect the display image. Alternatively, it is also possible to count pixels to be supplied with the data pulse to be turned on in advance and apply the data pulse to the dummy pixels only in the case where the counted number is less than $\gamma_0 M$.

Figure 24:
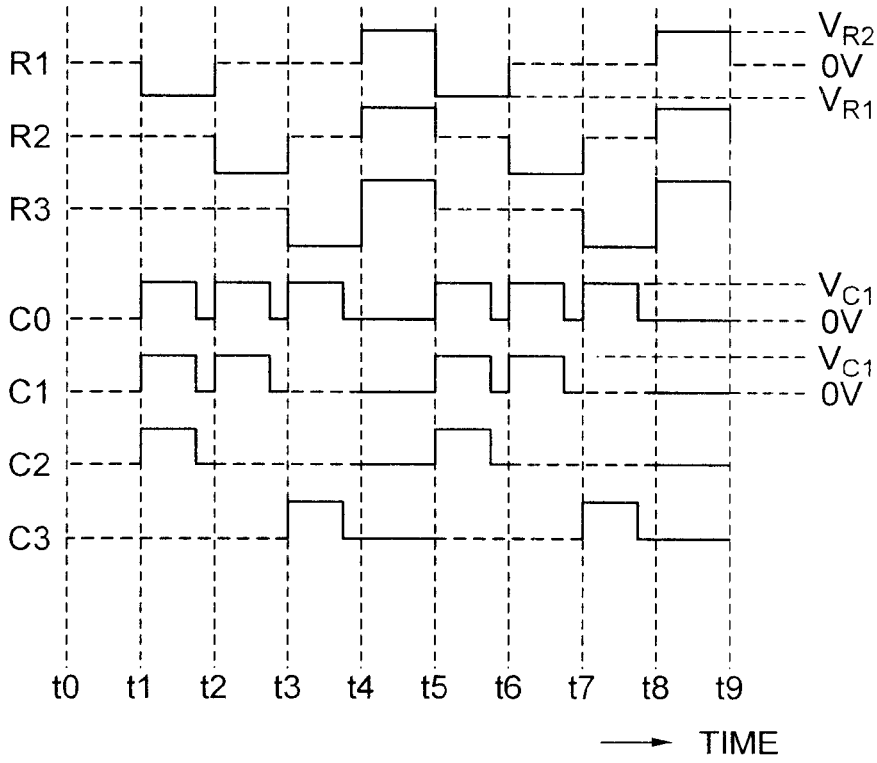
FIG. 24 is a diagram showing a part of another example of drive voltage waveforms in an image display apparatus of a third embodiment of the present invention.

FIG. 24 shows drive waveforms used in a different embodiment. A display panel and a connection method between the display panel and drive circuits are the same as those of the third embodiment.

In the present embodiment, a data pulse having an amplitude $V_{C1}$ is applied to the column electrodes (311) C1 and C2 in an interval between time t1 and t2 to make dots (R1, C1) and (R1, C2) luminous. Thereafter, however, the column electrodes (311) C1 and C2 are returned to the ground potential once. On the other hand, a column electrode (311) C3 which is not supplied with the data pulse remains to be connected to the ground potential of the high impedance. In the present embodiment, the column electrodes C1 and C2 are returned to the ground potential of a low impedance and then set to the high impedance state. Therefore, the potential of unselected column electrodes 311 becomes floating in the vicinity of the ground potential. As a result, forward voltage applied to luminance modulation elements 301 becomes small, and occurrence of crosstalk is prevented further certainly.

Figure 34:
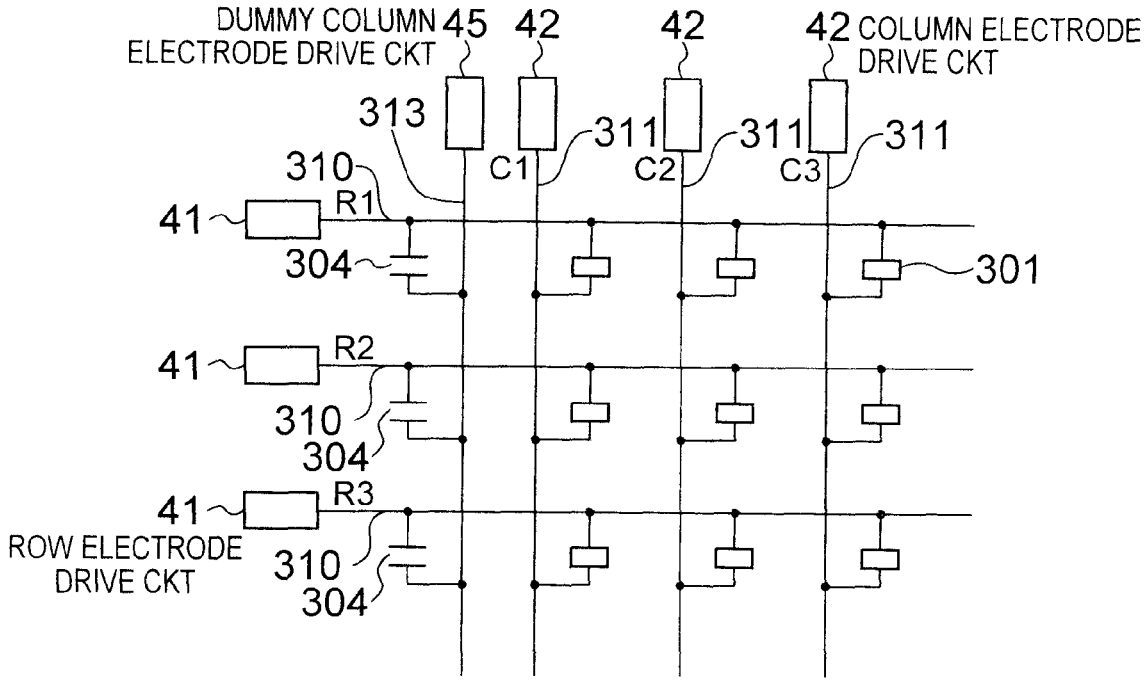
FIG. 34 is a diagram showing a connection method of luminance modulation elements of an image display apparatus in a different embodiment of the present invention.

FIG. 34 is a diagram schematically showing connections of luminance modulation elements 301 in a display panel used in a different embodiment. A configuration of a luminance modulation element 301 and its fabrication method used in the present embodiment are the same as those of the third embodiment.

In the present embodiment, a dummy capacitance 304 is provided between each of row electrodes 310 and a dummy column electrode 313. A capacitance value of the dummy capacitance 304 is set to a value in the range satisfying the expression (13). The dummy column electrode 313 is connected to a dummy column electrode drive circuit 45.

In FIG. 34, one dummy column electrode 313 is provided. Alternatively, it is also possible to provide a plurality of dummy column electrodes 313 and provide a plurality of dummy capacitances 304 as well for each row electrode. In this case, the total value of the dummy capacitances per row should satisfy the expression (13).

For example, if a plurality of capacitances each having the same structure as that of the luminance modulation element 301 are provided as the dummy capacitances 304, there is obtained an advantage that the dummy capacitances 304 and the luminance modulation elements 301 can be formed in the same fabrication process.

Figure 35:
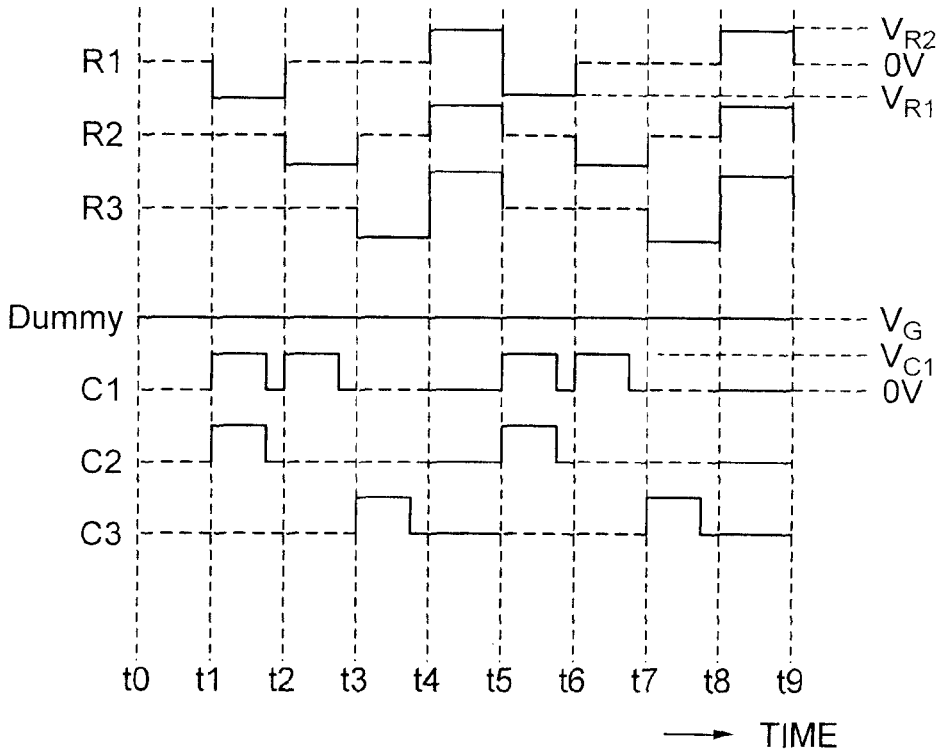
FIG. 35 is a diagram showing drive voltage waveforms of an image display apparatus in a different embodiment of the present invention.

FIG. 35 is a diagram showing output waveforms of respective drive circuits. The dummy column electrode drive circuit 45 outputs a constant potential $V_G$ with a low impedance. In the present embodiment, $V_G$ is set equal to $V_G$=0 V. Other waveforms are the same as those of the immediately preceding embodiment (FIG. 24).

Figure 36:
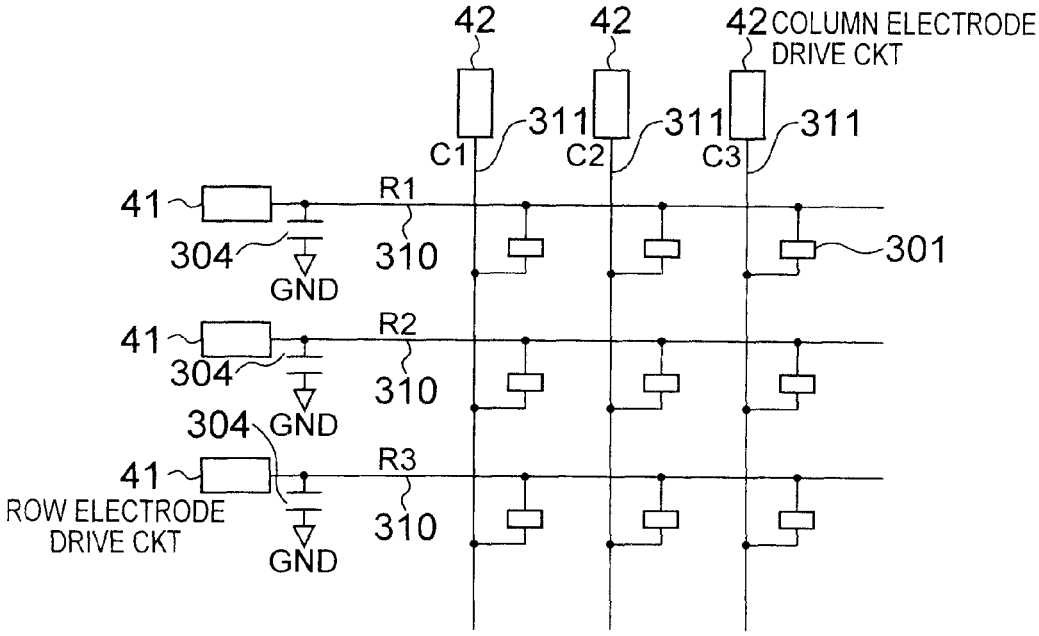
FIG. 36 is a diagram showing a connection method of luminance modulation elements of an image display apparatus in a different embodiment of the present invention.

FIG. 36 is a diagram showing connections between a display panel and drive circuits used in a different embodiment. The display panel used in the present embodiment is the same as that of the first embodiment.

In the present embodiment, a dummy capacitance 304 is connected to an output terminal of each of row electrode drive circuits 41. A capacitance value of the dummy capacitance 304 is set to a value in the range satisfying the expression (13). Drive voltage waveforms in the present embodiment are the same as those shown in FIG. 35.

Fourth Embodiment

Figure 25:
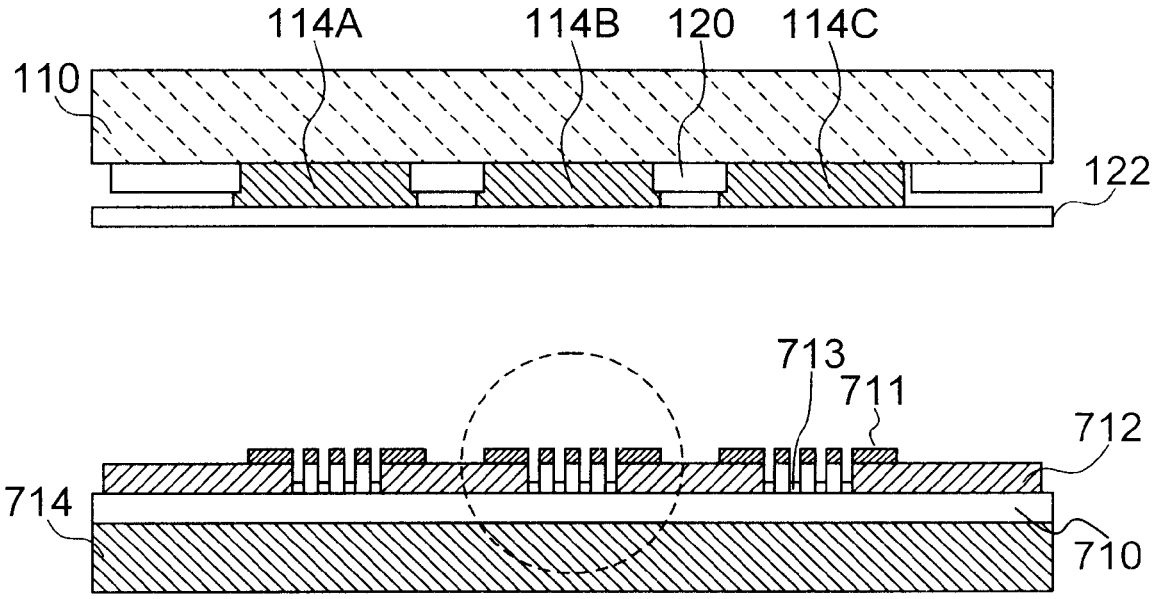
FIG. 25 shows sectional views of a principal part showing a configuration of a display panel of an image display apparatus in a fourth embodiment of the present invention.

A configuration of a display panel used in an image display apparatus of a fourth embodiment of the present invention will now be described by referring to FIG. 25.

A display panel of a display apparatus includes a substrate having an electron emission element matrix formed thereon and a phosphor plate having phosphor materials formed thereon. FIG. 25 shows a sectional view of a display panel. On a substrate 714 made of an insulative material such as glass or ceramic, cathode conductors 710 are formed. As many cathode conductors 710 as the number of scanning lines of the display apparatus are formed. Gate electrodes 711 are formed on an insulation layer 712. The gate electrodes 711 are formed so as to perpendicular to the cathode conductors 710. As many gate electrodes 711 as the number of columns of the display apparatus are formed. A plurality of gate holes are formed in each of regions where the gate electrodes 711 intersect cathode conductors 710. A cathode 713 is formed on a bottom portion of each gate hole. As the cathode 713, a carbon nano-tube is used.

Figure 26A:
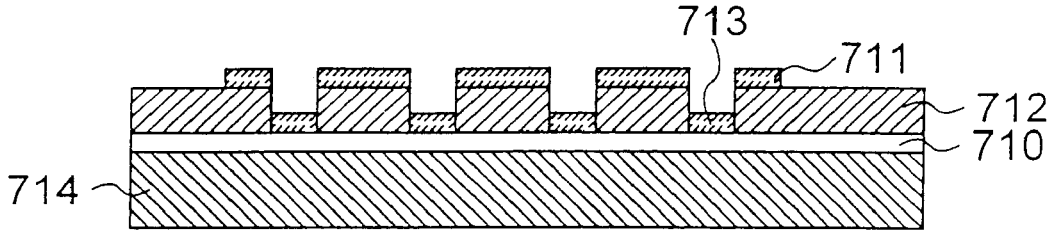
FIGS. 26A and 26B respectively show a sectional view and a top view of a principal part showing a configuration of a display panel of an image display apparatus in a fourth embodiment of the present invention.
Figure 26B:
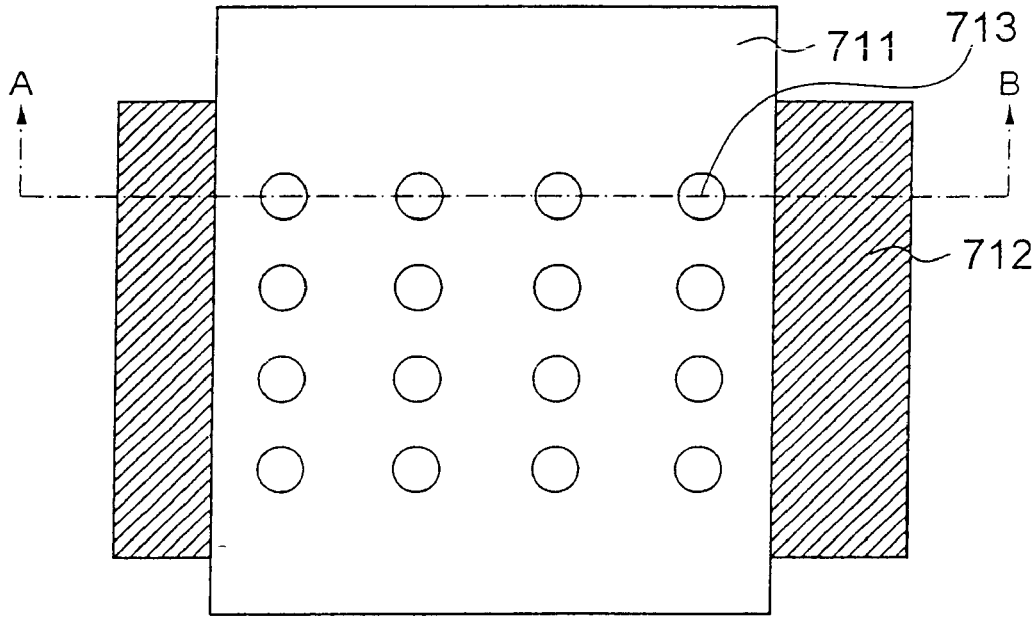

Enlarged views of a gate electrode—cathode conductor intersecting portion (a portion surrounded by a broken line in FIG. 25) are shown in FIGS. 26A and 26B. FIG. 26B is a top view, and FIG. 26A is a sectional view taken along a line A-B. As occasion demands, a resistance layer may be formed between the cathode 713 and the cathode conductor 710. The forming method of this substrate is described in, for example, Materials Research Society Symposium Proceedings, Vol. 509, 1998, pp. 107 to 112. In the present embodiment, each of the gate holes provided in each of intersecting regions of the gate electrodes 711 and the cathode conductors 710 has a diameter of 20 $\mu$m, and the thickness of the insulation layer 712 is set to 20 $\mu$m. The number of gate holes provided in each of the intersecting regions, i.e., the number of gate holes per pixel is typically in the range of several to several hundreds.

A structure of the phosphor plate, a construction method of the phosphor plate and the substrate, an evacuation method of the inside of the panel are the same as those of the first embodiment.

Connections between electrodes of the display panel and drive circuits are the same as those of FIG. 10. However, the cathode conductors 710 correspond to the row electrodes 310 and the gate electrodes 711 correspond to the column electrodes 311. In the present embodiment, a gate type electron source element formed of the cathode conductor 710, the cathode 713, the insulation layer 712, and the gate electrode 711 corresponds to the thin film electron emitter element 301.

Figure 27:
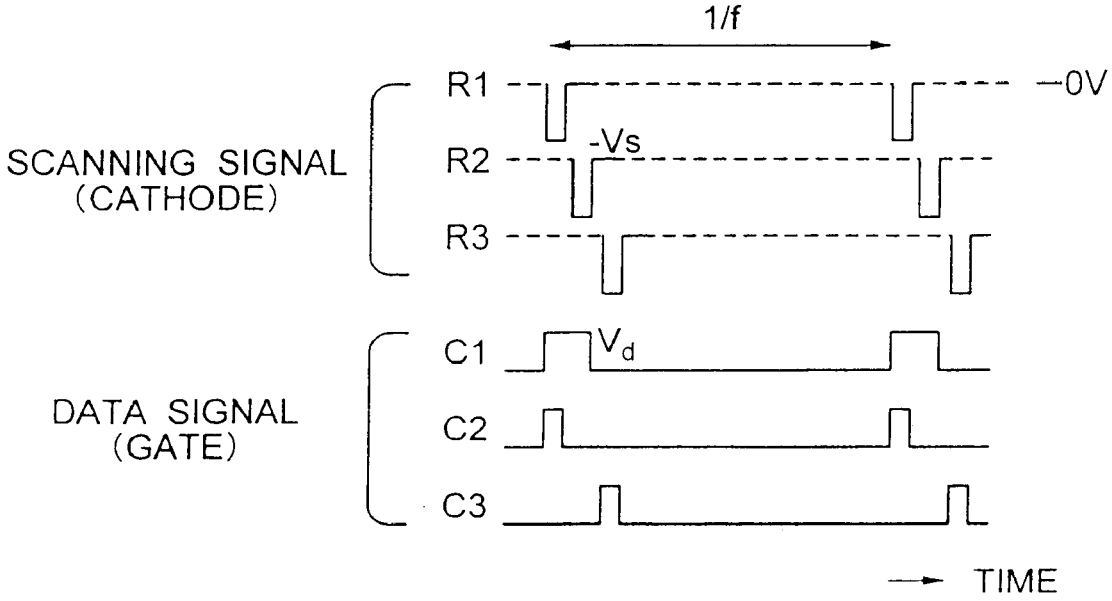
FIG. 27 is a diagram showing a part of drive voltage waveforms in an image display apparatus of a fourth embodiment of the present invention.

FIG. 27 shows output voltage waveforms of respective drive circuits. A scanning pulse (a voltage of $-V_s$) is applied to a row electrode (310) R1 to set the row electrode (310) R1 to a selection state. If a data pulse (a voltage of $V_d$) is applied to column electrodes (311) C1 and C2 in this interval, then a voltage of $(V_s+V_d)$ is applied between the gate electrode and the cathode of each of dots (R1, C1) and (R1, C2), and electrons are emitted. When applying a scanning pulse to a row electrode (310) R2 and thereby setting the row electrode (310) R2 to a selection state, the adjacent row electrode (310) R1 is connected to the ground potential of a low impedance. In other intervals, i.e., in such an interval that neither the row electrode nor the adjacent row electrode is selected, the row electrode is connected to the ground potential via a high impedance. As a result, the dissipation power of the column electrode drive circuits can be reduced.

Here, an example in which row electrodes 310 in nonselection intervals are connected to the ground potential has been shown. Alternatively, however, the row electrodes 310 in nonselection intervals may be connected to a potential other than the ground potential. For example, if row electrodes in nonselection intervals are set to a positive potential, electron emission in nonselection intervals can be prevented certainly. This is effective in reduction of display crosstalk. In this case, unselected row electrodes should be connected to the positive potential via a high impedance in the broken line interval of FIG. 27.

A gate type electron emission element formed of the cathode conductor 710, the cathode 713, the insulation layer 712, and the gate electrode 711 is a "unipolar" device which emits electrons only when a positive potential is applied to the gate electrode. Even if the drive method of the present invention is used, therefore, crosstalk does not occur.

In the present embodiment, the example in which a carbon nano-tube is used as the cathode 713 has been described. In the case where a diamond cathode is used, a diamond film may be used as the cathode 713. A fabrication method of the substrate is described in, for example, IEEE Transaction Electron Devices, Vol. 46, No. 4, 1999, pp. 787 to 791.

Furthermore, not only electron emission elements using a carbon nano-tube but also typical electron emission elements such as Spindt type field emission elements and ballistic electron surface emission elements are "unipolar" devices. Therefore, the drive method according to the present invention can be applied to them.

Fifth Embodiment

As an image display apparatus of a fifth embodiment of the present invention, an embodiment using organic electroluminescence as luminance modulation elements will now be described by referring to FIG. 28. Organic electroluminescence is called organic light-emitting diode as well. Hereafter, the organic electroluminescence is referred to as organic light-emitting element.

On a light transmitting substrate 814 made of glass or the like, an anode 811 is formed by using a light transmitting conductor such as ITO (Indium Tin Oxide). The anode 811 is patterned so as to form as many columns as display columns of the display apparatus. Subsequently, cathode partitions 813 are formed. Thereafter, organic layers 812 are formed, and cathodes 810 are formed.

Each of the organic layers 812 has a laminated structure including a buffer layer, a hole transport layer, a light-emitting layer, and an electron transport layer in the cited order when seen from the anode 811 side. Concrete materials and a more detailed fabrication method of the organic layer 812 are described, for example, in 1997 SID International Symposium Digest of Technical Papers, pp. 1073 to 1076, published in May, 1997.

Alternatively, a polymer material doped with a light-emitting material may be used for the organic layer 812. To be concrete, it is described in, for example, 1999 SID International Symposium Digest of Technical Papers, pp. 372 to 375, published in May, 1999.

Figure 28:
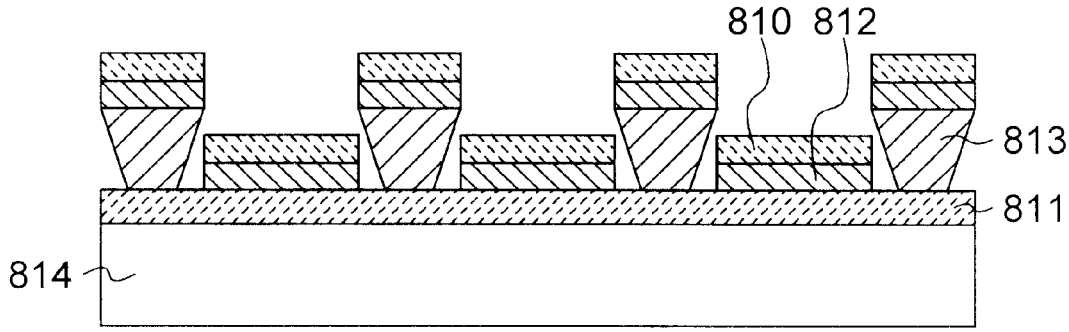
FIG. 28 is a sectional view of a principal part showing a configuration of a display panel of an image display apparatus in a fifth embodiment of the present invention.

Although not illustrated in FIG. 28, a metal can or the like is attached to the substrate 814 and sealing is conducted. And the inside is replaced by nitrogen gas, or a water catching agent such as barium oxide is attached. By doing so, water is prevented from penetrating into the organic layers 812 or the cathodes 810.

Figure 29:
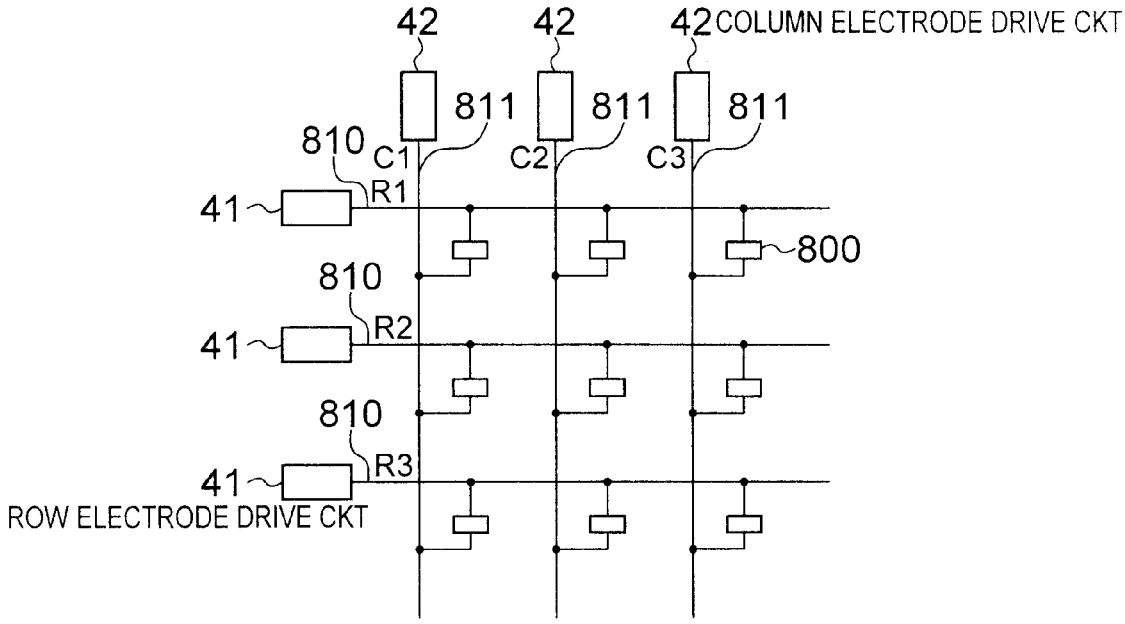
FIG. 29 is a diagram showing connections between a display panel and drive circuits in an image display apparatus of a fifth embodiment of the present invention.

A connection method between the display panel and drive circuits is shown in FIG. 29. The cathodes 810 are connected to the scanning line side (row side), and the scanning lines are connected to row electrode drive circuits 41. The anodes 811 are connected to the data line side (column side), and the data lines are connected to column electrode drive circuits 42.

Figure 30:
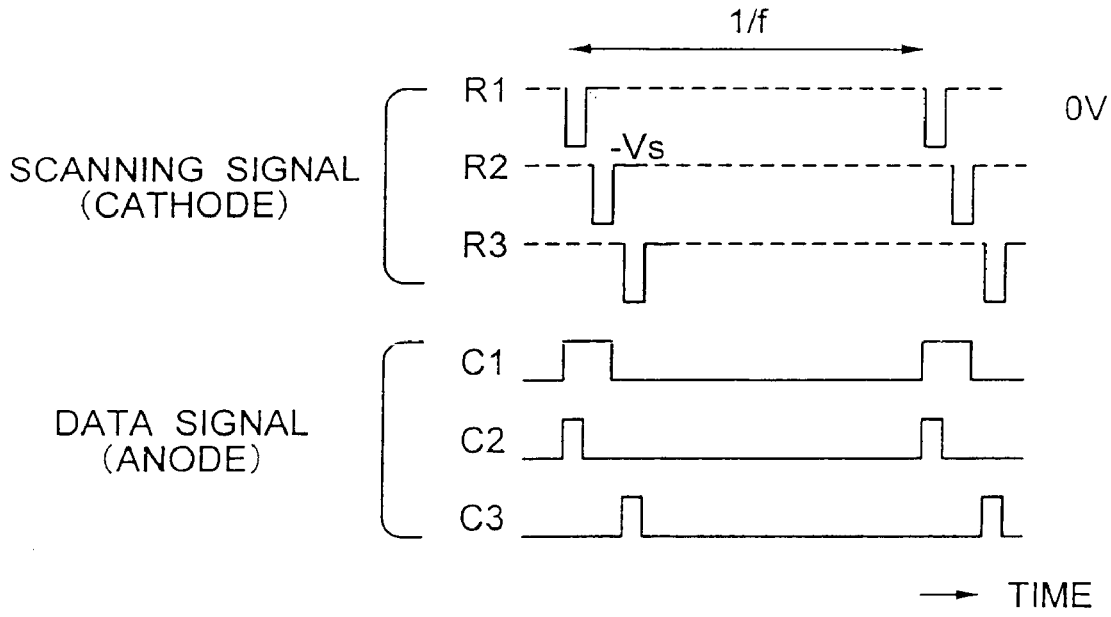
FIG. 30 is a diagram showing a part of drive voltage waveforms in an image display apparatus of a fifth embodiment of the present invention.

FIG. 30 shows drive waveforms of respective drive circuits. A scanning pulse (a voltage of −Vs) is applied to a cathode (810) R1 to set the cathode (810) R1 to a selection state. By applying a constant current pulse to each of anodes (811) C1 and (811) C2 at this time, a predetermined forward current flows through each of organic light-emitting elements 800 of dots (R1, C1) and (R1, C2) and they emit light. On the other hand, an anode (811) C3 is connected to the ground potential of a low impedance. Since a sufficient voltage is not applied to an organic light-emitting element 800 of a dot (R1, C3), it does not emit light. By thus changing output waveforms of the column electrode drive circuits, a desired image or desired information can be displayed.

When subsequently applying a pulse of −Vs to a cathode (810) R2 and thereby selecting the cathode (810) R2, the cathode (810) R1 which is an adjacent row is set to the ground potential with a low impedance. In other intervals, the cathode (810) R1 is set to a high impedance state.

In this example, a cathode 810 adjacent to a cathode 810 in the selection state is set to the ground potential of the low impedance. In the case where crosstalk of the display is sufficiently small even if the adjacent cathode 810 is set to the ground potential of the high impedance, the adjacent cathode 810 may also be set to the high impedance state.

Sixth Embodiment

As an image display apparatus of a sixth embodiment of the present invention, an embodiment using organic light-emitting elements as luminance modulation elements will now be described by referring to FIG. 31. A display panel used in the present embodiment and a method for connection to drive circuits are the same as those shown in FIGS. 28 and 29.

Figure 31:
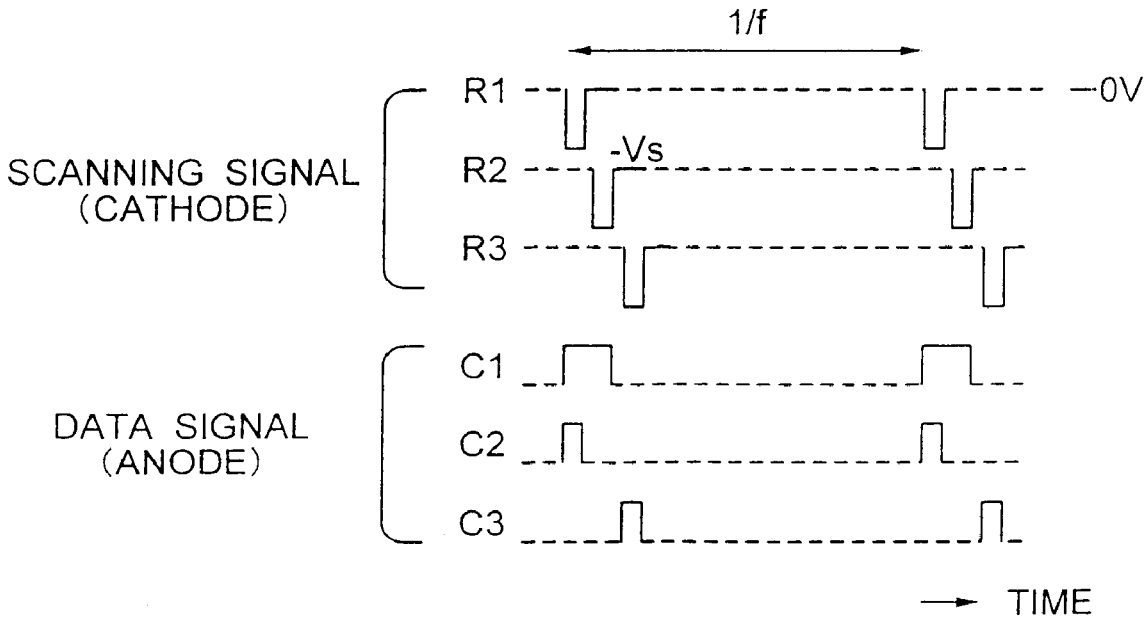
FIG. 31 is a diagram showing a part of drive voltage waveforms in an image display apparatus of a sixth embodiment of the present invention.

FIG. 31 shows drive waveforms of respective drive circuits. A scanning pulse (a voltage of −Vs) is applied to a cathode (810) R1 to set the cathode (810) R1 to a selection state. By applying a constant current pulse to each of anodes (811) C1 and (811) C2 at this time, a predetermined forward current flows through each of organic light-emitting elements 800 of dots (R1, C1) and (R1, C2) and they emit light. On the other hand, an anode (811) C3 is set to a high impedance output and no current is flown thereto. Therefore, an organic light-emitting element 800 of a dot (R1, C3) does not emit light. By thus changing output waveforms of the column electrode drive circuits, a desired image or desired information can be displayed.

When subsequently applying a pulse of −Vs to a cathode (810) R2 and thereby selecting the cathode (810) R2, the cathode (810) R1 which is an adjacent row is set to the ground potential with a low impedance. In other intervals, the cathode (810) R1 is set to a high impedance state.

In the present embodiment, unselected column electrode drive circuit outputs are set to the high impedance state. As compared with the immediately preceding embodiment, therefore, the power can be further reduced.

Seventh Embodiment

As an image display apparatus of a seventh embodiment of the present invention, an embodiment using organic light-emitting elements as luminance modulation elements will now be described by referring to FIG. 37. A display panel used in the present embodiment and output waveforms of drive circuits are the same as those shown in FIGS. 28 and 30.

Figure 37:
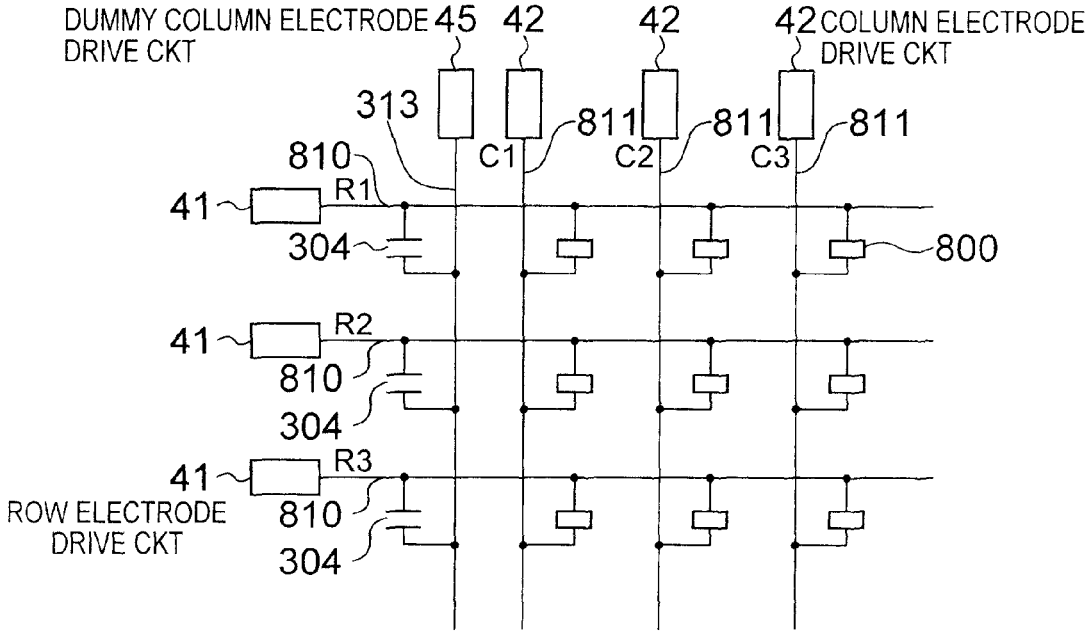
FIG. 37 is a diagram showing a connection method of organic light-emitting diode elements in a display panel of an image display apparatus of a different embodiment of the present invention.

FIG. 37 is a diagram showing a connection method of organic light-emitting elements 800 in the present embodiment. In the present embodiment, a dummy capacitance is formed between respective cathodes 810 and a dummy column electrode 313, and the dummy column electrode 313 is connected to a dummy column electrode drive circuit 45.

The dummy column electrode drive circuit 45 is set to the ground potential of the low impedance. A capacitance value of the dummy capacitance is set so as to satisfy the expression (13).

In the present embodiment, occurrence of crosstalk can be further prevented due to the effect of the dummy capacitance 304.

An effect obtained by the present invention will now be described simply.

According to an image display apparatus of the present invention, it becomes possible to reduce the dissipation power caused by charging and discharging a capacitance component of each luminance modulation element, and thereby reduce the power consumption.

What is claimed is:

1. A display apparatus comprising:

a plurality of luminance modulation elements each modulated in luminance by a voltage of a positive polarity applied thereto, each of said luminance modulation elements being not modulated in luminance by a voltage of an opposite polarity applied thereto, each of said luminance modulation elements comprising a combination of a thin film electron emitter and a phosphor material, the thin film electron emitter having a top electrode, an electron accelertion layer, and a base electrode;

a plurality of first lines electrically coupled to first electrodes of said plurality of luminance modulation elements;

a plurality of second lines electrically coupled to second electrodes of said plurality of luminance modulation elements, said plurality of second lines intersecting said plurality of first lines;

a first drive unit coupled to said plurality of first lines and outputting scanning pulses thereto; and a second driver unit coupled to said plurality of second lines, wherein said first drive unit subsequently sets each one of the first lines in a nonselection state to a selection state, said nonselection state of a high impedance state having a higher impedance as compared with the first lines in the selection state, and wherein in an interval for shifting said one of the first lines in the selection state to the nonselection state of the high impedance state, said first drive unit sets said one of the first lines in the selection state to a nonselection level potential of a lower impedance as compared with the high impedance state.

2. A display apparatus according to claim 1, wherein said first drive unit outputs a voltage having a polarity which becomes an opposite polarity to the luminance modulation elements, to the first lines in the nonselection state.

3. A display apparatus according to claim 1, wherein said first drive unit sets at least one of two first lines adjacent to each of the first lines in the selection state to a fixed potential in such an interval that said each of the first lines is in the selection state, and said first drive unit sets remaining first lines to a higher impedance state as compared with the first lines in the selection state.

4. A display apparatus according to claim 1, wherein said first drive unit comprises switchover circuits, each of which is provided for corresponding one of the first lines, and a plurality of pulse circuits for outputting pulses differing in phase from each other.

5. A display apparatus according to claim 1, wherein the impedance of said high impedance state is larger than or equal to 1 MΩ.

6. A display apparatus according to claim 1, wherein each of the first lines in the nonselection state has a floating potential.

7. A display apparatus comprising:

a plurality of luminance modulation elements each modulated in luminance by a voltage of a positive polarity applied thereto, each of said luminance modulation elements being not modulated in luminance by a voltage of an opposite polarity applied thereto, each of said luminance modulation elements comprising a combination of a thin film electron emitter and a phosphor material, the thin film electron emitter having a top electrode, an electron acceleration layer, and a base electrode;

a plurality of first lines electrically coupled to first electrodes of said plurality of luminance modulation elements;

a plurality of second lines electrically coupled to second electrodes of said plurality of luminance modulation elements, and plurality of second lines intersecting said plurality of first lines;

a first drive unit coupled to said plurality of first: lines, said first drive unit outputting scanning pulses; and a second driver unit coupled to said plurality of second lines, wherein said first drive unit subsequently sets each one of the first lines in a nonselection state to a selection state, said nonselection state of a high impedance state having a higher impedance as compared with the first lines in the selection state, wherein said second driver unit sets the second lines in a nonselection state to a high impedance state having a higher impedance as compared with the second lines in a selection state, and wherein in an interval for shifting said one of the first lines in the selection state to the nonselection state of the high impedance state, said first drive unit sets said one of the first lines in the selection state to a nonselection level potential of a lower impedance as compared with the high impedance state.

8. A display apparatus according to claim 7, wherein in an interval for shifting the second lines from the selection state to the nonselection state of the high impedance state, said second driver unit sets the second lines in the selection state to a nonselection level potential of a lower impedance as compared with the high impedance state.

9. A display apparatus according to claim 7, wherein said first drive unit outputs a voltage having a polarity which becomes an opposite polarity to the luminance modulation elements, to the first lines in the nonselection state.

10. A display apparatus according to claim 7, wherein said first drive unit sets at least one of two lines adjacent to each of the first lines in the selection state to a fixed potential in such an interval that said each of the first lines is in the selection state, and said first drive unit sets remaining first lines to a higher impedance state as compared with the first lines in the selection state.

11. A display apparatus according to claim 10, wherein said first drive unit comprises switchover circuits, each of which is provided for corresponding one of the first lines, and a plurality of pulse circuits for outputting pulses differing in phase from each other.

12. A display apparatus according to claim 7, further comprising:

at least one third line; and additional capacitances coupled between said plurality of first lines and said at least one third line, wherein said third line is set to a state which is lower in impedance than said high impedance state.

13. A display apparatus according to claim 12, wherein each of the additional capacitances has a capacitance value $C_d$ satisfying the following expression:

$$C_d > 0.3MC_e/[N\{0.7-(V_G/V_K)\}]$$

where N is the number of the first lines (where N is an integer), M is the number of the second lines (where M is an integer), $C_e$ is a capacitance of each of the luminance modulation elements, $V_K$ is a voltage applied to the first line in the selection state, and $V_G$ is a potential of the third line.

14. A display apparatus according to claim 12, wherein each of said additional capacitances comprises a capacitance part of each of said luminance modulation element.

15. A display apparatus according to claim 7, further comprising:

at least one third line; and additional capacitances coupled between said plurality of first lines and said at least one third line, wherein said third line is set to a fixed potential.

16. A display apparatus according to claim 7, wherein the impedance of said high impedance state is larger than or equal to 1 MΩ.

17. A display apparatus according to claim 7, wherein each of the first lines in the nonselection state has a floating potential.

18. A display apparatus according to claim 7, wherein each of the first lines in the nonselection state and the second lines in the nonselection state has a floating potential.

19. A display apparatus according to claim 7, further comprising a plurality of drive-unit additional capacitances coupled between a drive-unit constant potential line and a plurality of output portions coupled to said plurality of said first lines of said first drive unit, respectively, wherein each of said drive-unit additional capacitances has a capacitance value $C_d$ satisfying the following expression:

$$C_d > 0.3MC_e/[N\{0.7-(V_G/V_K)\}]$$

where N is a number of said first lines (where N is an integer), M is a number of said second lines (where M is an integer), $C_e$ is a capacitance of each of said luminance modulation elements, $V_K$ is a voltage applied to said first line in the selection state, and $V_G$ is a potential of said drive-unit constant potential line.

20. A display apparatus comprising:

a plurality of luminance modulation elements each modulated in luminance by a voltage of a positive polarity applied thereto, each of said luminance modulation elements being not modulated in luminance by a voltage of an opposite polarity applied thereto;

a plurality of first lines electrically coupled to the first electrodes of said plurality of luminance modulation elements;

a plurality of second lines electrically coupled to second electrodes of said plurality of luminance modulation elements, said plurality of second lines intersecting said plurality of first lines;

a first drive unit coupled to said plurality of first lines and outputting scanning pulses thereto; and a second driver unit coupled to said plurality of second lines and outputting data pulses thereto, wherein each of said plurality of luminance modulation element is not modulated in luminance in response to only one of said scanning pulse and said data pulse applied thereto but modulated in luminance in response to both of said scanning pulse and said data pulse applied thereto, wherein said first drive unit subsequently sets each one of the first lines in a nonselection state to a selection state, said nonselection state of a high impedance state having a higher impedance as compared with the first lines in the selection state, and wherein in an interval for shifting said one of the first lines in the selection state to the nonselection state of the high impedance state, said first drive unit sets said one of the first lines in the selection state to a nonselection level potential of a lower impedance as compared with the high impedance state.

21. A display apparatus comprising:

a plurality of luminance modulation elements each modulated in luminance by a voltage of a positive polarity applied thereto, each of said luminance modulation elements being not modulated in luminance by a voltage of an opposite polarity applied thereto;

a plurality of first lines electrically coupled to first electrodes of said plurality of luminance modulation elements;

a plurality of second lines electrically coupled to second electrodes of said plurality of luminance modulation elements, said plurality of second lines intersecting said plurality of first lines; a first drive unit coupled to said plurality of first lines and outputting scanning pulses thereto; and a second driver unit coupled to said plurality of second lines and outputting data pulses thereto, wherein each of said plurality of luminance modulation elements is not modulated in luminance in response to only one of said scanning pulse and said data pulse applied thereto but modulated in luminance in response to both of said scanning pulse and said data pulse applied thereto, wherein said first drive unit subsequently sets each one of the first lines in a nonselection state to a selection state, said nonselection state of a high impedance state having a higher impedance as compared with the first lines in the selection state, wherein said second drive unit sets the second lines in a nonselection state: to a high impedance state having a higher impedance as compared with the second lines in a selection state, and wherein in an interval for shifting said one of the first lines in the selection state to the nonselection state of the high impedance state, said first drive unit sets said one of the first lines in the selection state to a nonselection level potential of a lower impedance as compared with the high impedance state.

22. A display apparatus according to claim 20, wherein said first drive unit outputs a voltage having a polarity which becomes an opposite polarity to the luminance modulation elements, to the first lines in the nonselection state.

23. A display apparatus according to claim 20, wherein each of said luminance modulation elements comprises a combination of a thin film electron emitter and a phosphor material, and the thin film electron emitter has a top electrode, an electron acceleration layer, and a base electrode.

24. A display apparatus according to claim 21, wherein said first drive unit outputs a voltage having a polarity which becomes an opposite polarity to the luminance modulation elements, to the first lines in the nonselection state.

25. A display apparatus according to claim 21, wherein each of said luminance modulation elements comprises a combination of a thin film electron emitter and a phosphor material, and the thin film electron emitter has a top electrode, an electron acceleration layer, and a base electrode.

* * * * *